US008260173B2

(12) United States Patent
Takamura

(10) Patent No.: US 8,260,173 B2
(45) Date of Patent: Sep. 4, 2012

(54) COLOR ELECTROPHOTOGRAPHIC IMAGE FORMING APPARATUS

(75) Inventor: Daisuke Takamura, Fujinomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 429 days.

(21) Appl. No.: 12/568,951

(22) Filed: Sep. 29, 2009

(65) Prior Publication Data

US 2010/0080627 A1 Apr. 1, 2010

(30) Foreign Application Priority Data

Sep. 30, 2008 (JP) ..... 2008-253338
Sep. 18, 2009 (JP) ..... 2009-216947

(51) Int. Cl.
*G03G 15/00* (2006.01)

(52) U.S. Cl. ..... 399/112

(58) Field of Classification Search ..... 399/112, 399/167, 298, 299, 111; 347/115, 117
See application file for complete search history.

(56) References Cited

U.S. PATENT DOCUMENTS

| | | | | |
|---|---|---|---|---|
| 5,250,989 | A * | 10/1993 | Morita et al. | 399/112 |
| 5,262,824 | A * | 11/1993 | Morita et al. | 399/25 |
| 6,708,011 | B2 | 3/2004 | Nomura et al. | |
| 6,708,013 | B2 * | 3/2004 | Nomura | 399/167 |
| 6,889,027 | B2 * | 5/2005 | Tachiki et al. | 399/297 |
| 7,565,096 | B2 * | 7/2009 | Murayama | 399/167 |
| 7,761,032 | B2 * | 7/2010 | Murayama | 399/112 |
| 7,769,329 | B2 * | 8/2010 | Shimura et al. | 399/299 |
| 2008/0159775 | A1 | 7/2008 | Koishi et al. | |

FOREIGN PATENT DOCUMENTS

| | | | |
|---|---|---|---|
| JP | 3-110572 | A | 5/1991 |
| JP | 6-138721 | A | 5/1994 |
| JP | 9-6209 | A | 1/1997 |
| JP | 2003-15378 | A | 1/2003 |
| JP | 2005-10273 | A | 1/2005 |
| JP | 2006-71661 | A | 3/2006 |
| JP | 2007-17777 | A | 1/2007 |

OTHER PUBLICATIONS

Office Action dated Feb. 9, 2010, in counterpart Japanese Application No. 2009-216947.
Notification of Reasons for Rejection mailed Apr. 27, 2010, in counterpart Japanese Application No. 2009-216947.
Japanese Notification of Reasons for Rejection dated Oct. 27, 2009 in Japanese Application No. 2009-216947, and an English-language translation therefor.

* cited by examiner

*Primary Examiner* — Robert Beatty
(74) *Attorney, Agent, or Firm* — Fitzpatrick, Cella, Harper & Scinto

(57) ABSTRACT

A color image forming apparatus to which cartridges are detachably mountable includes a cartridge supporting member movable between a set position and an outside position; a driving source; a driving member provided opposite to the driving source through the cartridge supporting member, a first driving force transmission member for transmitting a driving force of the driving source; a second driving force transmission member provided oppositely to the first driving force transmission member through the cartridge supporting member; and a third driving force transmission member provided to the cartridge supporting member. The third driving force transmission member is, in a state in which the cartridge supporting member is located at the set position, connected to the first and second driving force transmission members to transmit the driving force of the driving source to the driving member.

9 Claims, 24 Drawing Sheets

COLOR ELECTROPHOTOGRAPHIC IMAGE FORMING APPARATUS

FIELD OF THE INVENTION AND RELATED ART

The present invention relates to a color electrophotographic image forming apparatus for forming an image on a recording material in the state that a plurality of cartridges are dismountably mounted thereto.

Here, the electrophotographic image forming apparatus forms the image on the recording material using an electrophotographic image forming process. The examples of the electrophotographic image forming apparatus include an electrophotographic copying machine, an electrophotographic printer (a laser beam printer, a LED printer), and so on, a facsimile device, a word processor and so on.

The recording material is a material on which the image is formed by the electrophotographic image forming apparatus, and it is a paper sheet, an OHP sheet, or the like.

For example, the cartridge is process cartridge or a developing cartridge, and it is detachably mountable to a main assembly of the electrophotographic image forming apparatus to contribute to an image formation process for forming the image on the recording material. The process cartridge contains an electrophotographic photosensitive drum and at least one of charging means, developing means, cleaning means as process means, as an integral cartridge, and it is detachably mountable to the main assembly of the electrophotographic image forming apparatus. An example of the process cartridge contains the electrophotographic photosensitive drum and the developing means as the process means integrally, and it is detachably mountable to the main assembly. Another example of the process cartridge contains the electrophotographic photosensitive drum and the charging means, the developing means, or the cleaning means as the process means integrally, and it is detachably mountable to the main assembly. The process cartridge which has the electrophotographic photosensitive drum and the developing means integrally is called an integral type. In addition, the process cartridge which has the electrophotographic photosensitive drum and the process means other than the developing means integrally is called the discrete type.

The process cartridge can be mounted and demounted relative to a main assembly of the image forming apparatus by a user. For this reason, the maintenance of the apparatus is easy. The process means acts on the electrophotographic photosensitive drum.

In addition, the developing cartridge has a developing roller, accommodating a developer (toner), and is detachably mountable to the apparatus main assembly, wherein the developer is used by the developing roller in order to develop an electrostatic latent image formed on the electrophotographic photosensitive drum. In the case of the developing cartridge, the electrophotographic photosensitive drum is mounted to the apparatus main assembly or the cartridge supporting member as will be described hereinafter. Or, the electrophotographic photosensitive drum is provided in the discrete type process cartridge (in this case, the process cartridge does not comprise the developing means). In addition, the developing cartridge also is detachably mountable relative to the main assembly of the image forming apparatus by the user. For this reason, the maintenance of the apparatus is easy.

As for the cartridge, the integral-type process cartridge and the discrete type process cartridge are included. The cartridge includes a combination of the discrete type process cartridge and the developing cartridge. The cartridge includes the developing cartridge actable on the electrophotographic photosensitive drum, wherein the electrophotographic photosensitive drum is fixed to the main assembly or the cartridge supporting member as will be described hereinafter.

In the electrophotographic image forming apparatus, the cartridge is supported by a cartridge tray movable between an inside position and an outside position with respect to the apparatus main assembly. When the cartridge is exchanged, such a constitution that a cover is opened and then the tray is pulled out to the outside position has been known (U.S. Patent Application Publication No. US2008/0159775). In this constitution, at the outside position, exchange (mounting and demounting) of the cartridge with respect to the tray is performed. Thereafter, the tray is pushed into the inside position. Thus, the exchange of the cartridge with respect to the tray can be performed. Therefore, the user can easily perform an exchange (mounting and demounting) operation of the cartridge. Thus, maintenance is easy.

As described above, in the image forming apparatus using the cartridge tray, the cartridge tray moves across the inside of the apparatus main assembly. Therefore, it is considered that an arrangement of a driving force transmission constitution is subjected to constraints.

For example, in the case where the driving source is disposed on an upper side of the apparatus main assembly and a rotational driving force is intended to be transmitted to a member located on a lower side of the cartridge, the driving force transmission is required to be performing while avoiding the cartridge tray.

SUMMARY OF THE INVENTION

The present invention has solved the above-described problem.

A principal object of the present invention is to provide an electrophotographic image forming apparatus having realized a simple driving force transmission constitution in the case where a cartridge supporting member movable between an inside position located inside an image forming apparatus main assembly and an outside position located outside the image forming apparatus main assembly is used in a state in which cartridges are supported.

Another object of the present invention is to provide an electrophotographic image forming apparatus capable of effecting transmission of a driving force without increasing a size of the apparatus in the case where the cartridge supporting member is used.

A further object of the present invention is to efficiently drive a driving member by a driving source, provided oppositely to the driving member through the cartridge supporting member, in a state in which the cartridge supporting member is located at the set position.

A further object of the present invention is to provide an electrophotographic image forming apparatus having realized simplification of the driving force transmission constitution by providing a driving force transmission member to the cartridge supporting member.

According to an aspect of the present invention, there is provided a color electrophotographic image forming apparatus for forming an image on a recording material, wherein a plurality of cartridges is detachably mountable to a main assembly of the image forming apparatus, the image forming apparatus comprising:

a cartridge supporting member for supporting the cartridges, the cartridge supporting member being movable between a set position, inside the apparatus main assembly, in which the cartridges are to be located at an image forming position in which the cartridges effect image formation, and an outside position, outside the apparatus main assembly, in which the cartridges are mountable to and demountable from the cartridge supporting member;

a driving source;

a driving member provided at a position in which the driving member opposes the driving source through the cartridge supporting member in a state in which the cartridge supporting member is located at the set position;

a first driving force transmission member for transmitting a driving force of the driving source;

a second driving force transmission member provided at a position in which the second driving force transmission member opposes the first driving force transmission member through the cartridge supporting member in the state in which the cartridge supporting member is located at the set position; and a third driving force transmission member provided to the cartridge supporting member;

wherein the third driving force transmission member is, in the state in which the cartridge supporting member is located at the set position, connected to the first and second driving force transmission members to transmit the driving force of the driving source to the driving member.

According to the present invention, it is possible to realize a simple driving force transmission constitution in the case where a cartridge supporting member movable between an inside position located inside an image forming apparatus main assembly and an outside position located outside the image forming apparatus main assembly is used in a state in which cartridges are supported.

According to the present invention, it is possible to effect transmission of a driving force without increasing a size of the apparatus in the case where the cartridge supporting member movable between a set position located inside the image forming apparatus main assembly and the outside position is used in the state in which the cartridges are supported.

According to the present invention, it is possible to efficiently drive a driving member by a driving source, provided oppositely to the driving member through the cartridge supporting member, in a state in which the cartridge supporting member is located at the set position.

According to the present invention, in the case of using the cartridge supporting member, it is possible to effect the transmission of the driving force without increasing the size of the apparatus.

According to the present invention, it is possible to realize simplification of the driving force transmission constitution by providing a driving force transmission member to the cartridge supporting member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of a color electrophotographic image forming apparatus according to the present invention will be described specifically with reference to the drawings.

First Embodiment

General Structure of Image Forming Apparatus

Figure 1:
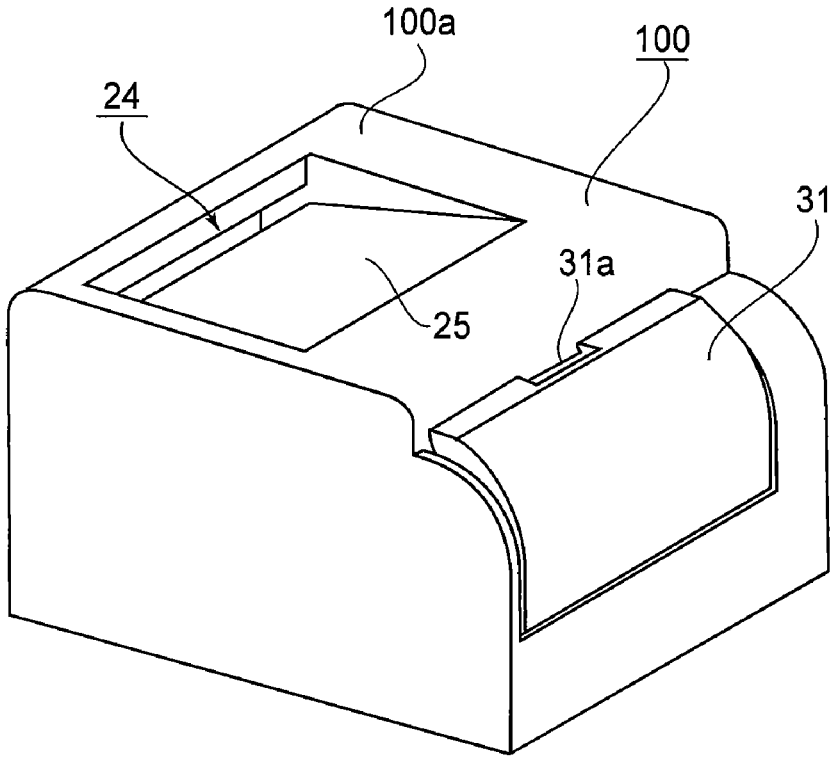
FIG. 1 is a perspective view of an outer appearance of an image forming apparatus.
Figure 2:
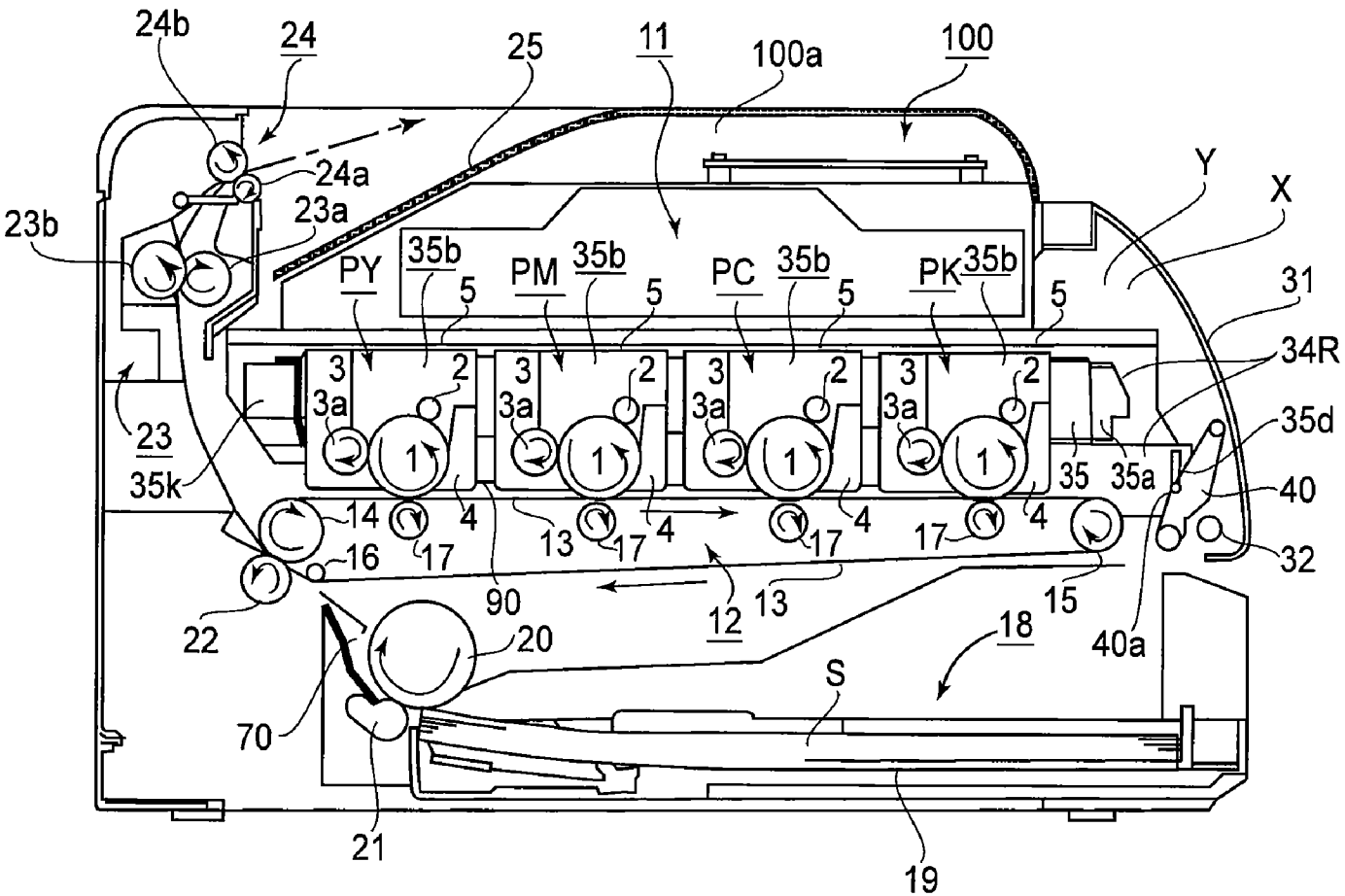
FIG. 2 is a longitudinal left side view of the image forming apparatus and a toner.
Figure 3:
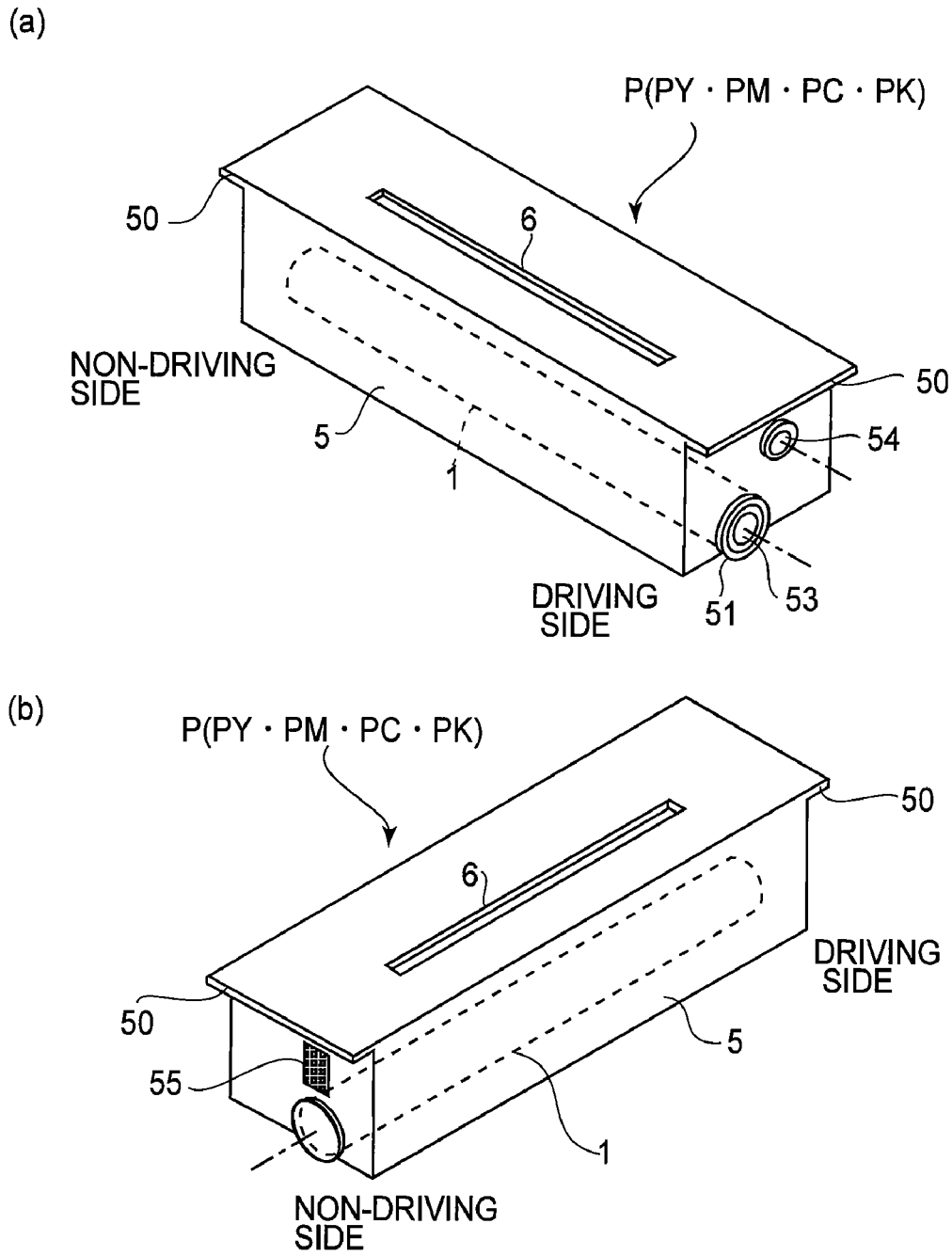
FIGS. 3(*a*) and 3(*b*) are perspective views each showing an outer appearance of a cartridge.

First, a general structure of an image forming apparatus 100*a* and a pull-out tray (cartridge supporting member) 35 in this embodiment will be described with reference to FIGS. 1 to 3. FIG. 1 is a perspective view of an outer appearance of the image forming apparatus 100*a* and FIG. 2 is a sectional illustration of the image forming apparatus 100*a*. FIG. 3 is a perspective illustration of a process cartridge P.

The apparatus 100*a* of this embodiment is a four color-based full-color laser printer. The apparatus 100*a* forms an image on a sheet (recording material) on the basis of an image signal input from an external host device such as a remote facsimile device or the like.

In the following description, with respect to the apparatus 100*a*, a front side is the side on which a door (opening/closing member) 31 is provided. A rear side is the side opposite from the front side. Left and right (left side and right side) are those of the apparatus main assembly as seen from the front side.

As shown in FIG. 2, in an image forming apparatus main assembly 100, first to fourth process cartridges P (PY, PM, PC, PK) are arranged and provided in a horizontal direction from the front side to the rear side. Each of the cartridges P has the same constitution except that the color of a developer (toner) accommodated therein is different. In this embodiment, description will be made by taking the process cartridge as an example but as described above, it is possible to apply other cartridge constitutions. The apparatus main assembly 100 has a constitution that a constitution of the cartridge tray (cartridge supporting member) 25 is removed from the constitution of the image forming apparatus 100*a*.

Each cartridge P includes an electrophotographic photosensitive drum 1 as a first image bearing member, and as process means acting on the drum 1, a charging device (charging means) 2, a developing device (developing means) 3, and a cleaning means) 4. The drum 1 and these process means are integrally mounted to a cartridge frame 5 (FIGS. 3(*a*) and 3(*b*)) to provide the cartridge P.

The charging device 2 is a contact charging roller. The developing device includes a developing roller 3*a* and a developer container in which the developer (toner) is accommodated. The cleaning device 4 is a cleaning blade. The developing roller 3*a* develops an electrostatic latent image formed on the photosensitive drum 1 with the developer.

The first cartridge PY accommodates the developer of yellow (Y) in the developing device 3 and forms a developer image of yellow on the drum 1. Similarly, the second cartridge PM accommodates the developer of magenta (M) and forms a magenta developer image on the drum 1. The third cartridge PC accommodates the developer of cyan (C) and forms a cyan developer image on the drum 1. The fourth cartridge PK accommodates the developer of black (K) and forms a black developer image on the drum 1.

As shown in FIG. 3(*a*), at one longitudinal side surface of the cartridge P, a cartridge-side drum coupling 53 for transmitting a rotating force to the photosensitive drum 1 and a cartridge-side developing device (roller) coupling 54 for transmitting the rotating force to the developing roller 3*a* are provided. Further, as shown in FIG. 3(*b*), at the other longitudinal side surface, an electrical contact 55 is provided. The longitudinal direction of the cartridge P coincides with that of the photosensitive drum 1 (the developing roller 3*a*). The coupling 53 is engaged with a main assembly-side drum coupling 400 (FIG. 19) provided to the main assembly, thus being supplied with the rotating force. The coupling 54 is engaged with a main assembly-side developing device coupling 300 (FIG. 19) provided to the main assembly 100, thus being supplied with the rotating force.

Each cartridge P is, in a state in which the cartridge P is supported by the pull-out tray (cartridge supporting member) 35 described later, pushed into the apparatus main assembly 100 by the user and is located at an image forming position X (the state shown in FIG. 2). In the image forming position, the cartridge P performs an image forming process. Further, in the image forming position, the photosensitive drum 1 contacts an endless belt (a member onto which an image is to be transferred) described later.

Above the cartridge P located at the image forming position, a laser scanner unit 11 is provided. This laser scanner unit 11 outputs laser light modulated correspondingly to image information for each color input from the external host device (not shown). The photosensitive drum 1 surface of each cartridge position is subjected to scanning exposure to the laser light through an exposure window 6 (FIGS. 3(*a*) and 3(*b*)) provided at an upper surface of the cartridge frame 5.

An electrophotographic system for forming the developer image on the drum 1 will be described. The drum 1 is electrically charged by the charging roller 2. The charged drum 1 is exposed to the laser light correspondingly to the image information. As a result, the electrostatic latent image is formed on the drum 1 correspondingly to the image information. The electrostatic latent image is developed with the developer by the developing roller 3*a*. As a result, on the drum 1, the developer image is formed.

Under each cartridge P located at the image forming position X, an intermediary transfer belt unit 12 is provided. The belt unit 12, as an intermediary transfer member (a second image bearing member), is formed of a dielectric material and includes a flexible endless belt 13, a driving roller 14 for circulatively moving the belt 13, a tension roller 15, and an auxiliary roller 16. The driving roller 14 and the auxiliary roller 16 are provided on the rear side of the inside of the main assembly 100. The tension roller is provided on the front side of the inside of the main assembly 100.

The photosensitive drum 1 of each cartridge P located at the image forming position X contacts an upper surface of the belt 13 at its lower surface. Inside the belt 13, a primary transfer roller 17 is provided oppositely to an associated drum 1 through the belt 13. To the driving roller 14, a secondary transfer roller 22 is disposed oppositely through the belt 13.

Below the belt unit 12, a feeding unit 18 is provided. The feeding unit 18 includes a feeding tray 19, a feeding roller 20, a separation pad, and the like. The feeding tray 19 can be pushed in or pulled out from the front side of the main assembly 100 (front loading).

At one upper rear portion of the inside of the main assembly 100, a fixing device 23 and a discharging roller pair 24 are provided. At an upper surface of the main assembly 100, a discharging tray 25 is provided. The fixing device 23 includes a fixing roller 23*a* and a pressing roller 23*b*. The discharging roller pair 24 includes a discharging rollers 24*a* and 24*b*.

When each cartridge P is mounted at the image forming position X in the main assembly 100, to driving force input portions (the cartridge-side drum coupling 53 and the cartridge-side developing device coupling 54) of the cartridge, driving force output portions (the main assembly-side coupling (not shown) and the main assembly-side developing device coupling (not shown)) are connected. Further, to the electrical contact 55 of the cartridge P, a main assembly-side power supply system (not shown) is connected.

During image formation, as described above, the developer images are formed on the respective photosensitive drums 1 by the electrophotographic process and are successively primary-transferred onto the belt 13. As a result, on the belt, a full-color image is formed. In synchronism with this image formation, a sheet S is conveyed by the feeding roller and the like from the feeding tray 19 to a secondary transfer portion as a nip between the secondary transfer roller 22 and the belt 13. By applying a bias to the transfer roller 22, the developer image on the belt 13 is transferred onto the sheet S.

The sheet S on which the developer image is transferred is conveyed into the fixing device (fixing means) 23 to be heated and pressed, so that the developer image is formed on the sheet P. The sheet S is then discharged on the discharging tray 25 by the discharging roller pair 24 (24*a*, 24*b*).

[Mounting and Demounting Constitution of Cartridge with Respect to Main Assembly]

A constitution for mounting and demounting the cartridge P with respect to the apparatus main assembly 100 will be described with reference to FIGS. 4 to 7. That is, the cartridge P is detachably mounted to the apparatus main assembly 100.

Figure 4:
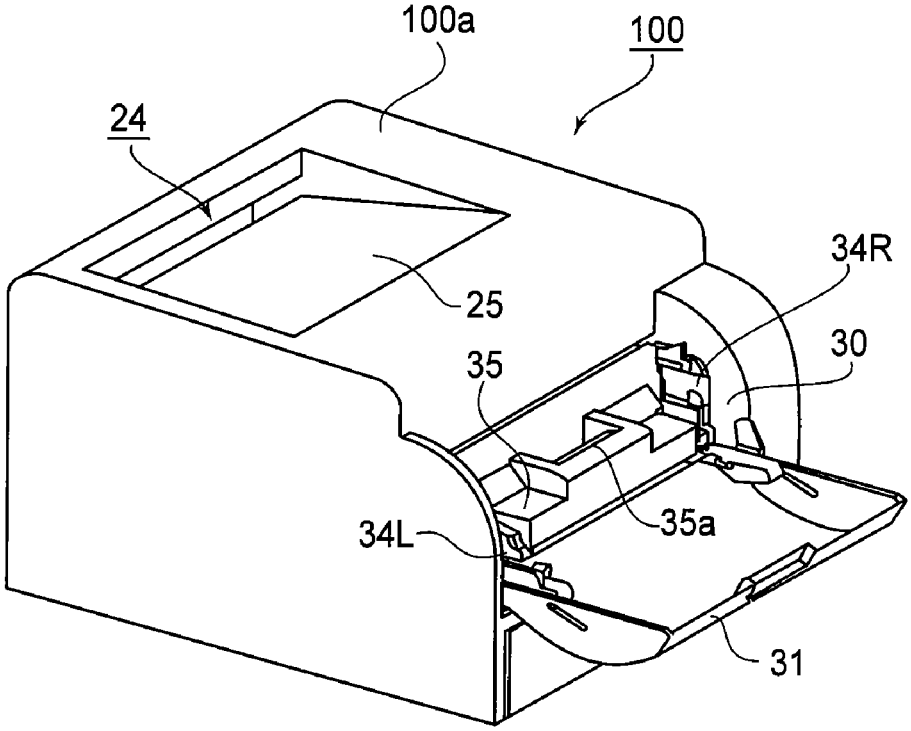
FIG. 4 is a perspective view of the outer appearance of the image forming apparatus in a state in which a door is opened.
Figure 5:
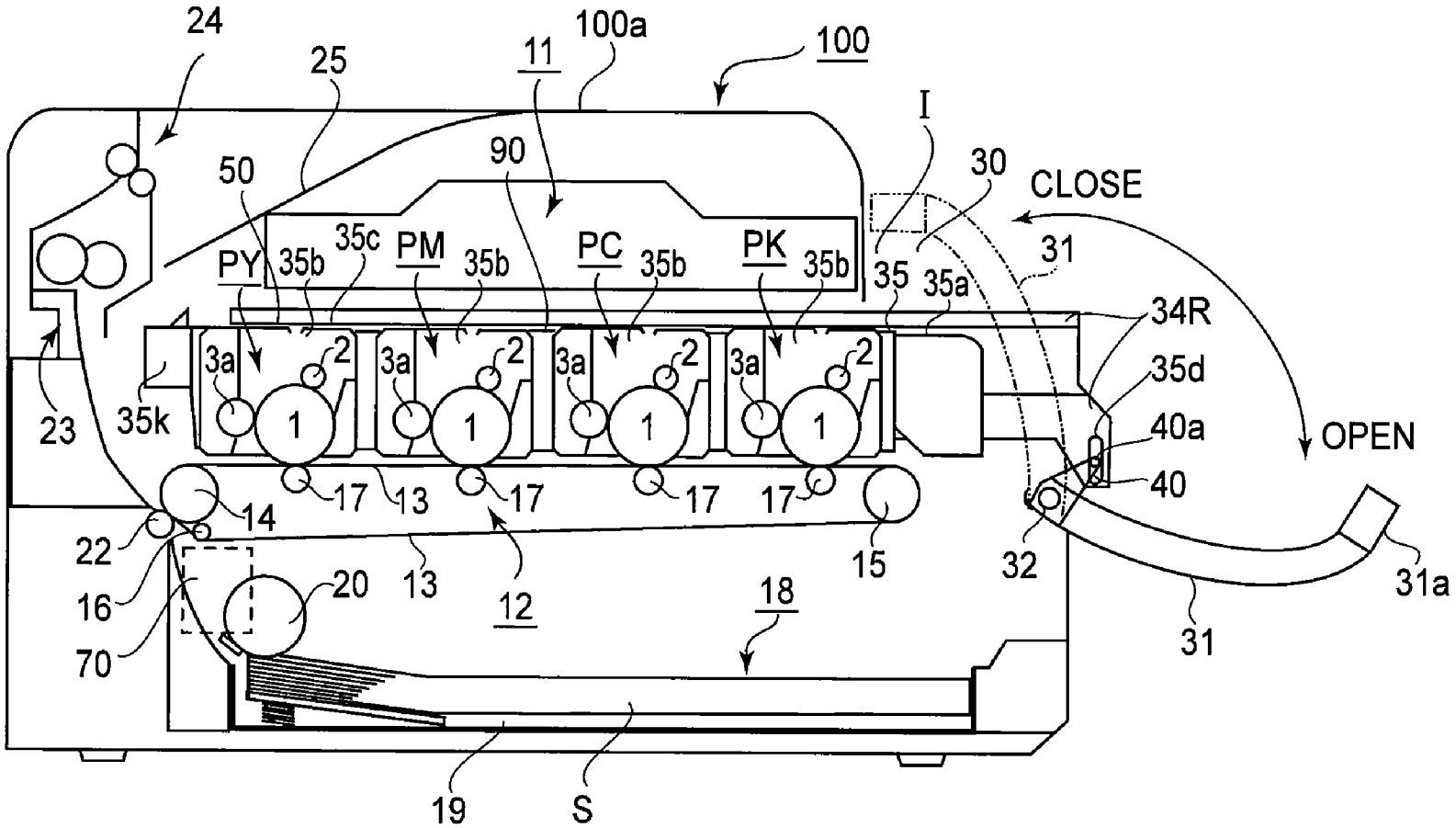
FIG. 5 is a longitudinal left side view of the image forming apparatus in the state in which the door is opened.

As shown in FIGS. 4 and 5, on the front side of the apparatus main assembly 100, a door 31 is provided rotatably about a shaft 32 provided at a lower portion thereof. As a result, an opening 30 provided in the apparatus main assembly 100 can be exposed and covered. That is, the opening 30 is covered with the door 31 in an exposable manner. At a front surface of the door 31, a grip portion 31*a* is provided. The user can open and close the door 31 while gripping the grip portion 31*a*.

Figure 6:
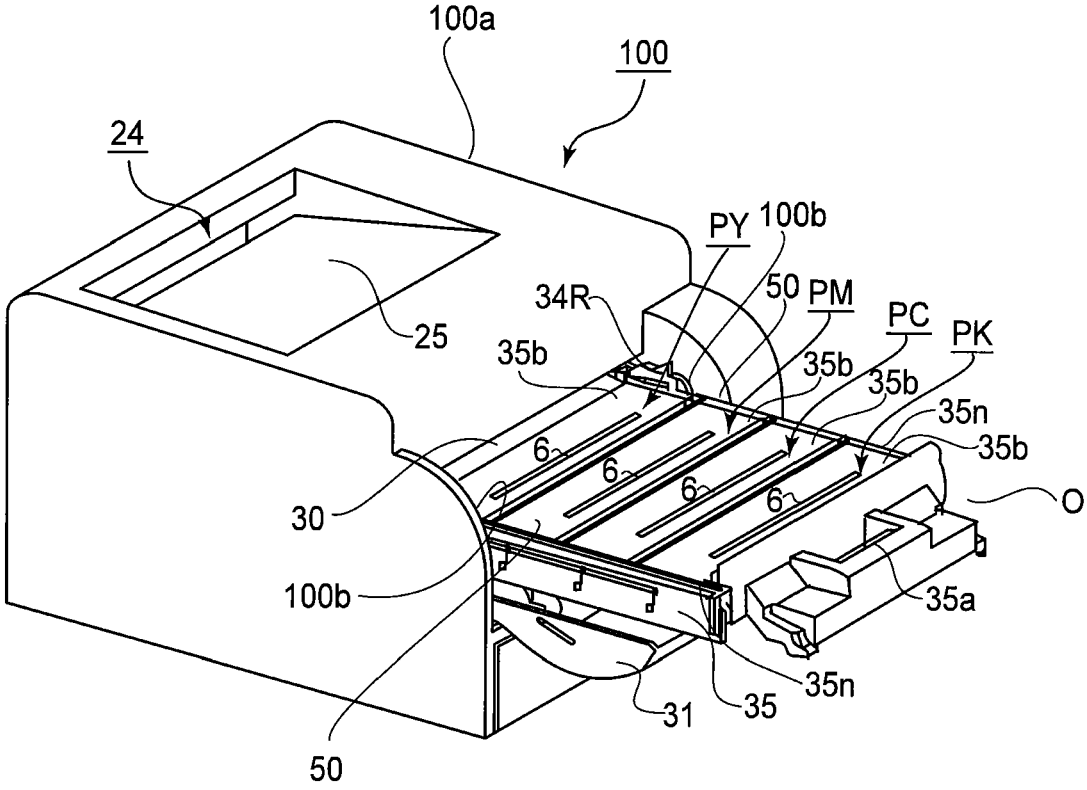
FIG. 6 is a perspective view of the outer appearance of the image forming apparatus in a state in which a tray is pulled out.

Inside the apparatus main assembly 100, a cartridge mounting space 90 in which the cartridge P is to be mounted is provided. In the space 90, the pull-out tray (cartridge supporting member) 35 slidably movable while supporting the cartridge P is mounted. As shown in FIG. 4, the tray 35 is slidably movable in a front-rear direction of the apparatus 100*a* in the space 90 by being guided along rails 34L and 34R. The rails 34L and 34R are provided on left and right inner walls (a main assembly frame) 100*b* (FIG. 6). The space 90 extends in the horizontal direction in the apparatus main assembly 100. The tray 35 moves across the inside of the apparatus main assembly 100.

At an upper surface of the cartridge P, the cartridge P is provided with a projection 50 outwardly projected from one longitudinal end thereof and with a projection 50 outwardly projected from the other longitudinal end thereof (FIGS. 3(*a*) and 3(*b*)). Each of the projections 50 is supported by an upper surface 35*n* of the pull-out tray 35 (FIG. 6). As a result, the cartridge P is roughly and detachably supported by (mounted on) the tray 35.

The tray 35 is provided with a supporting portion (mounting portion) 35*b* (FIGS. 2, 5 and 6) for supporting each cartridge P. Each cartridge P is supported by (mounted on) the supporting portion 35*b* by the user. As a result, the four cartridges PY, PM, PC and PK can be supported by the tray 35. As shown in FIG. 4, the tray 35 is provided with a grip portion 35*a* at a front end portion thereof. When the user opens the door 31, the grip portion 35*a* is exposed.

Figure 7:
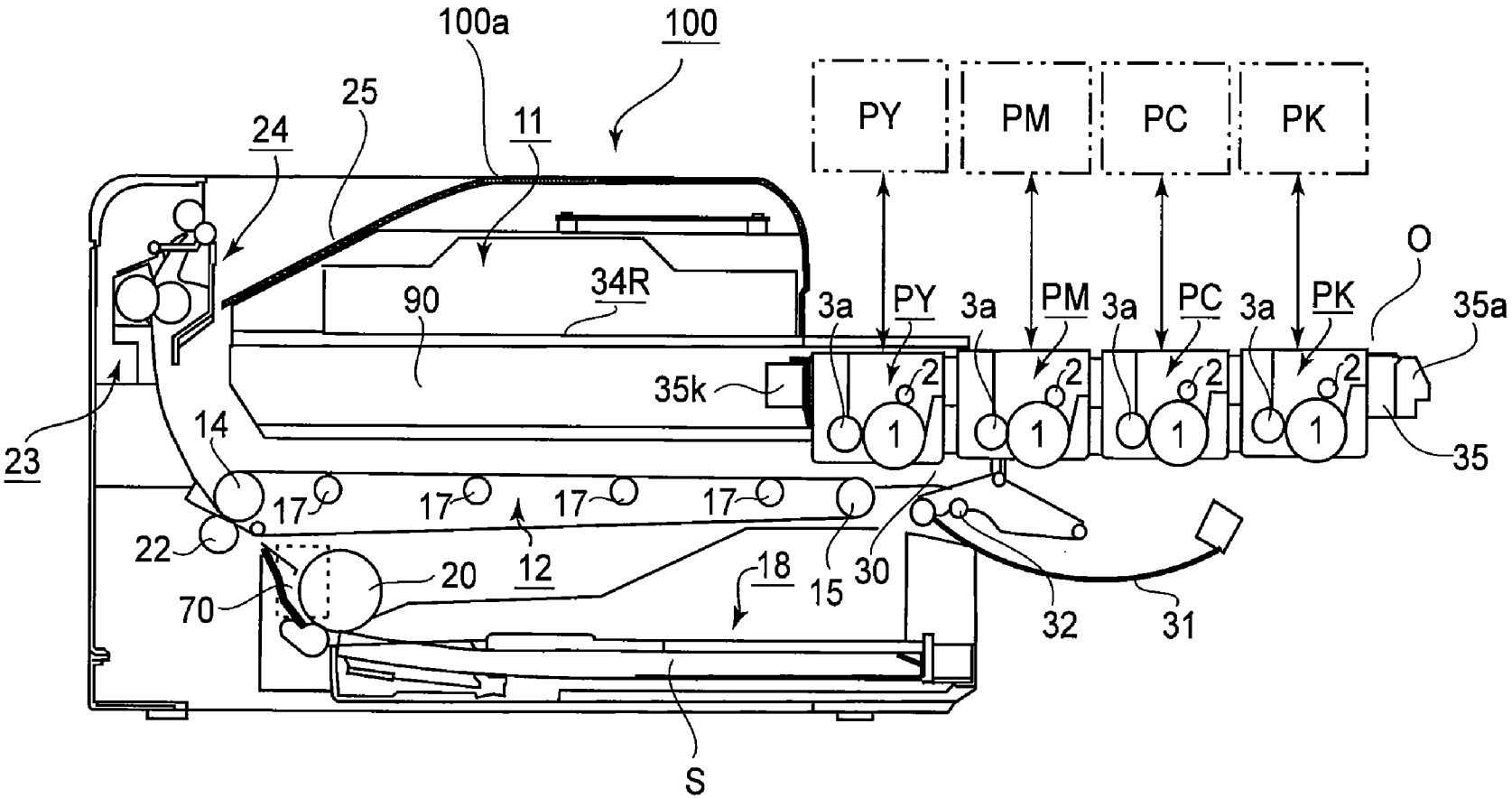
FIG. 7 is a longitudinal left side view of the image forming apparatus in the state in which the tray is pulled out.

When the cartridge P is mounted to and demounted from the apparatus main assembly 100, the user opens the door 31. Then, the user grips the grip portion 35*a* and pulls out the tray 35 to a predetermined position (outside position O (mounting and demounting position)). As a result, as shown in FIG. 6, the respective cartridges P supported by the tray 35 are exposed from the apparatus main assembly 100. Thus, as shown in FIG. 7, the user can upwardly demount the respective cartridges P. Therefore, the user can easily exchange the cartridge P. The cartridges P are supported by the tray 35 and the tray 35 is slidable. As a result, the plurality of cartridges P is easily demountable from and mountable to the apparatus main assembly 100.

After the user exchanges (mounts) a desired cartridge P with respect to the tray 35 pulled out to the outside position O, the user pushes the tray 35 into the inside position I in the apparatus main assembly 100 by sliding the tray 35 toward the rear side of the apparatus 100*a*. When the user pushes the tray 35 to a predetermined position of the inside position I, an abutting portion 35K provided to an end portion of the tray 35 abuts against a positioning portion 100-*a* (FIG. 12(*b*)) of the apparatus main assembly 100. Then, the user closes the door 31. As will be described later, in interrelation with the closing operation of the door 31, the tray is lowered, so that the cartridge P reaches the image forming position X. Thus, the photosensitive drum 1 contacts the belt 13. Further, in interrelation with the closing operation of the door 31, the drum coupling 53 and the developing device coupling 54 are connected to the above-described driving force output portions. Further, as described above, to the electrical contact 55, an electrical contact (not shown) of the apparatus main assembly 100 is connected.

In such a state, the cartridge P is positioned at the image forming position X.

The tray (cartridge supporting member) 35 is movable between the inside position I located inside the apparatus main assembly 100 and the outside position O located outside the apparatus main assembly 100. More specifically, the tray 35 is, while supporting the cartridge P, movable between the set position Y located inside the apparatus main assembly 100 and in which the cartridge P is located at the image forming position X in which the cartridge P effects image formation, and the outside position O located outside the apparatus main assembly 100.

Each cartridge P is positioned at the image forming position X by being urged at its upper surface by an urging member (not shown) provided to the main assembly 100. The urging member elastically urges each cartridge P by an elastic force of a spring member (not shown). The urging member elastically urges each cartridge position in interrelation with the closing operation of the door 31. In interrelation with the opening operation of the door 31, the urging member moves each cartridge P from the urging position. A constitution thereof will be omitted from explanation.

The tray 35 is raised and moved away from the image forming position X in interrelation with the opening operation of the door 31 (FIG. 5). That is, the photosensitive drum 1 is separated from the transfer belt 13. Thereafter, the tray 35 is pulled out to the outside position O by the user. Further, the tray 35 is pushed in from the outside position O to the predetermined position of the inside position I by the user. Thereafter, the tray 35 is lowered to the image forming position X in interrelation with the closing operation of the door 31 (FIG. 2). That is, the photosensitive drum 1 contacts the transfer belt 13. A mechanism for raising and lowering the tray 35 in interrelation with the opening and closing operations of the door 31 will be described. As shown in FIGS. 2 and 5, a lever 40 movable in interrelation with the door 31 is provided. The lever 40 is provided with a dowel 40*a*. The tray 35 is provided with an elongated hole 35*d*. The dowel 40*a* is engaged in the elongated hole 35*d*. By the closing operation of the door 31, the dowel 40*a* pushes the lower surface of the elongated hole 35*d*. As a result, the tray 35 is lowered against an elastic force of a spring (not shown). On the other hand, by the opening operation of the door 31, the dowel 40*a* is separated from the lower surface of the elongated hole 35*d*. As a result, the tray 35 is raised.

As described above, in the image forming apparatus 100 in this embodiment, the front access system excellent in usability is employed as the exchanging system of the cartridge P. In this system, in a state in which the cartridge P is placed (supported) on the tray 35 configured to be pullable, the user pulls out the tray 35 toward the front side of the apparatus main assembly 100. Then, in the state in which the tray 35 is pulled out from the apparatus main assembly 100, the user upwardly demounts the cartridge P which is decreased in remaining amount and is to be exchanged, from the tray 35. Then, the user places a fresh cartridge P on the tray 35 from above. In this embodiment, the cartridge P is exchanged in the above-described manner.

The tray 35 moves linearly when the user pulls out the tray 35 from the outside position P and pushes in the tray 35 to the inside position I. The tray 35 moves in parallel to a mounting surface (not shown) of the apparatus 100*a*. However, the movement direction of the tray 35 is not limited to the parallel (horizontal) direction but may also be an obliquely upward direction or an obliquely downward direction. Further, the tray 35 also moves in a direction perpendicular to a longitudinal direction of the cartridge P supported by the tray 35, i.e., a direction perpendicular to the longitudinal direction of the photosensitive drum 1 of the cartridge P. By the tray 35, the cartridge P is supported in a roughly mounted state. Further, between the tray 35 and the rail 34L (34R), there is play. Therefore, the above-described direction perpendicular to the longitudinal direction of the cartridge P (the photosensitive drum 1) includes not only the case where the tray 35 moves in the direction precisely perpendicular to the longitudinal direction but also the case where the tray 35 moves in the direction perpendicular to the longitudinal direction with the play.

Figure 15:
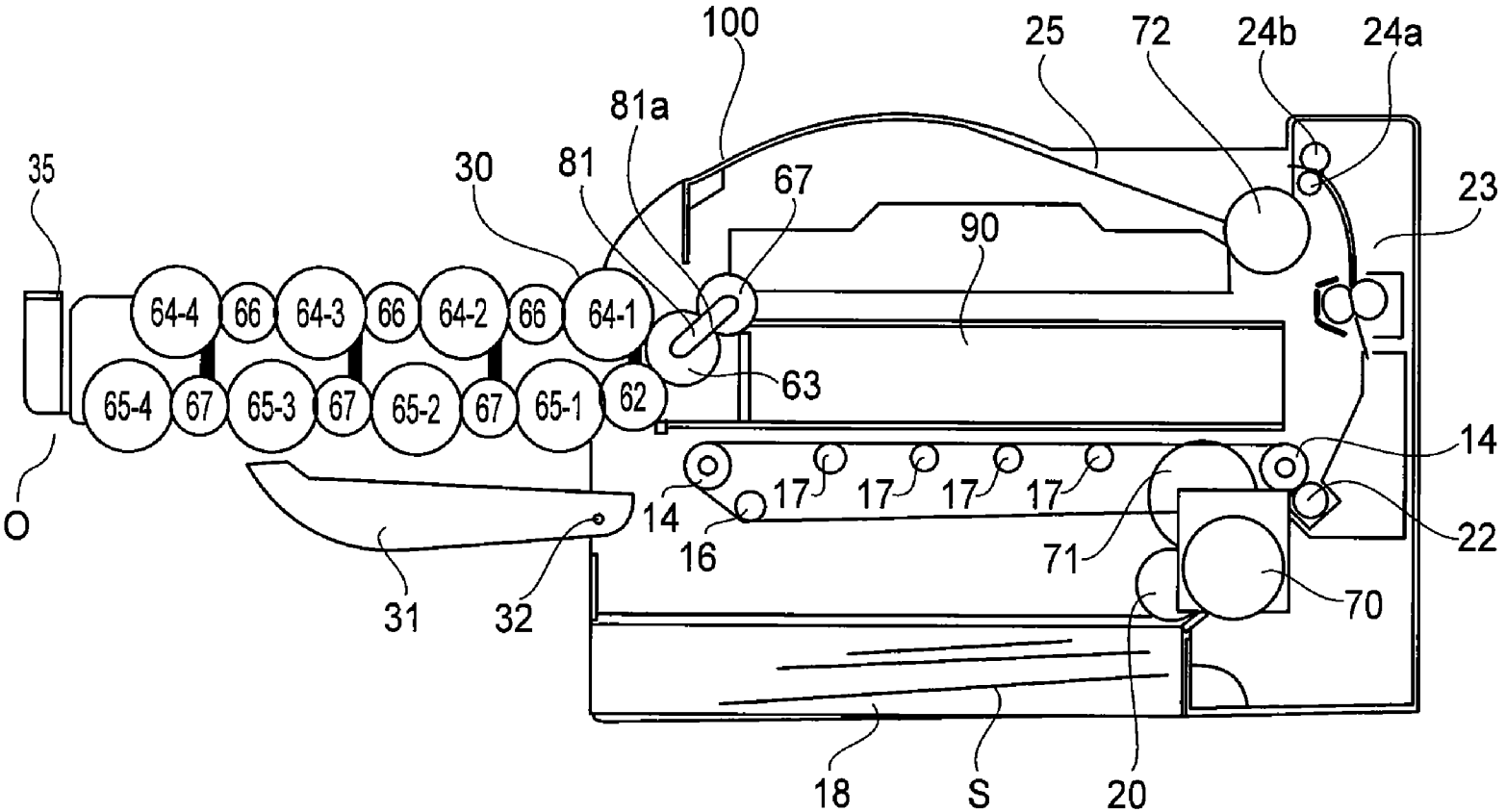
FIG. 15 is a sectional illustration of driving force transmission constitution when a tray in Second Embodiment is located at a cartridge mounting and demounting position.

As described above, on the front side of the apparatus main assembly 100, the opening 30 for permitting insertion of the cartridge P into the apparatus main assembly 100 and demounting of the cartridge P from the apparatus main assembly 100 is provided (e.g., FIGS. 6 and 15). The opening 30 is exposed and covered in interrelation with the opening and closing operations of the door 31.

In the apparatus 100*a*, a pair of inner walls (main assembly frame) 100*b* as a framework by the main assembly 100 is provided. To the inner walls 100*b*, the rails (main assembly-side guides) 34L and 34R are provided. These rails 34L and 34R are disposed oppositely to each other. Further, between the pair of rails 34L and 34R, the tray 35 formed in a frame shape provided. The pair of rails 34L and 34R supports the tray 35 slidably movable in the front-rear direction and in the horizontal direction. Thus, the rails 34L and 34R have the function of supporting the tray 35 slidably and movably. The tray 35 includes the support portions (mounting portions) for the four cartridges PY, PM, PC and PK and has the function of supporting these cartridges.

The tray 35 passes through the opening 30 in the state in which the tray 35 supports the respective cartridges P, thus being moved between the set position Y corresponding to the image forming position X of the main assembly 100 and the outside position O located outside the main assembly 100. That is, the tray 35 moves between the set position Y (FIGS. 2, 9, 10(*c*), 11, 16, 18, 21 and 25) located inside the opening 30 and the outside position O (FIGS. 6 to 8, 10(*a*), 15, 17(*a*) and 20) located outside the opening 30. The tray 35 is located at the outside position O by being pulled out from the set position Y by the user and is located at the set position Y by being pushed in from the outside position O by the user. In the state in which the tray 35 is located at the outside position O, the exchange, the mounting, and the demounting of the cartridge P with respect to the tray 35 are performed by the user. The set position Y of the tray 35 is a position of the tray 35 when each cartridge P is located at the image forming position X. In the state in which the tray 35 is located at the set position Y, the cartridge P can also partly rises from the tray 35 while being not completely supported by the tray 35.

The main assembly frame is not limited to the framework of the main assembly but may also include, e.g., a cover which covers a part or all of the framework of the main assembly. In the case where the cover is provided, the opening is provided also to the cover.

The tray 35 cannot be removed from the main assembly 100. This is because an engaging portion (not shown) of the tray 35 runs against a stopper (not shown) provided to the main assembly 100 and therefore the tray 35 cannot be pulled out further. However, the tray 35 may also be configured to be demounted from the main assembly 100.

[Driving Force (Rotating Force) Transmission Constitution]

Figure 8:
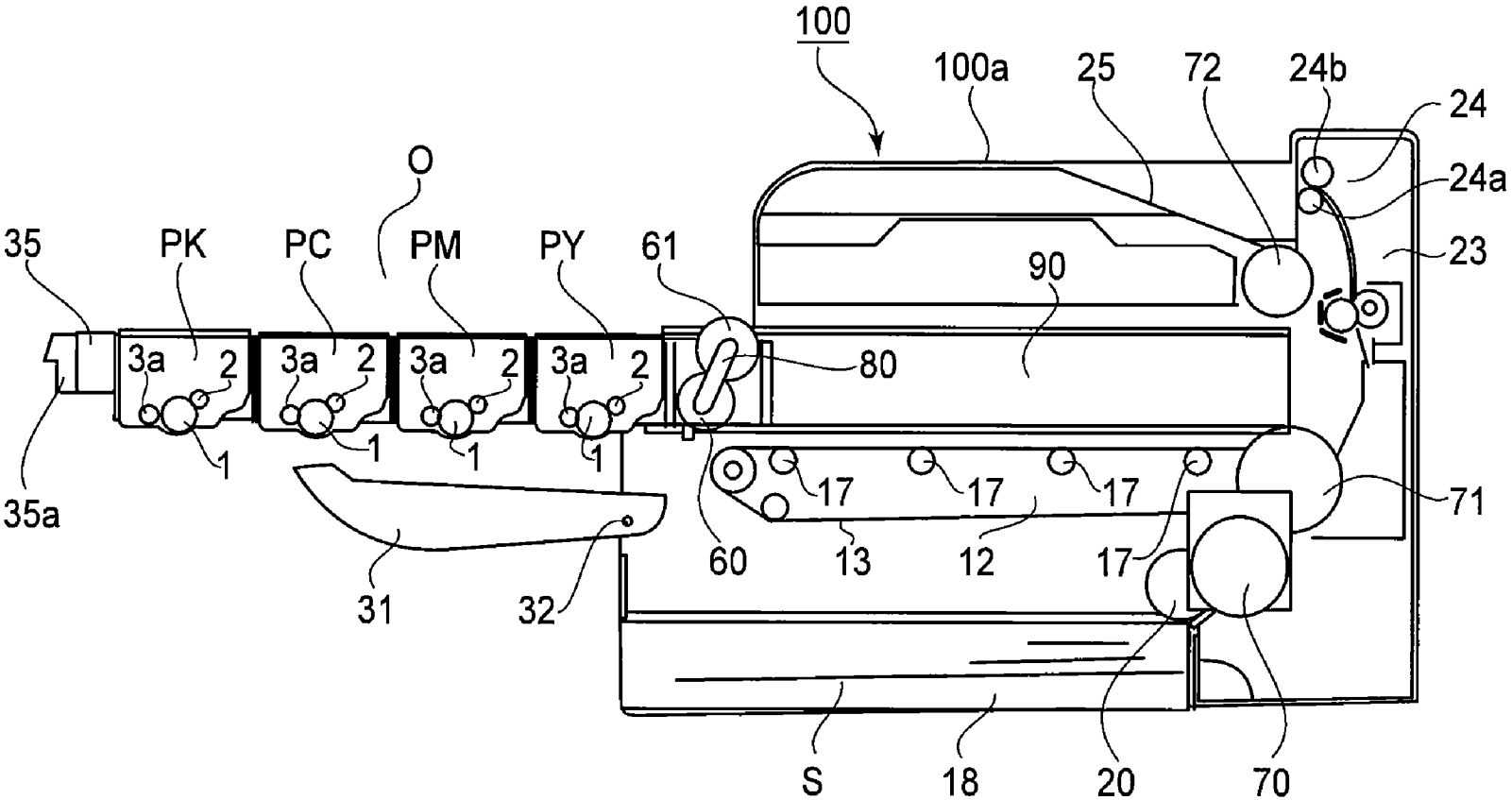
FIG. 8 is a sectional illustration of a driving force transmission constitution when the tray is located at an outside position.
Figure 9:
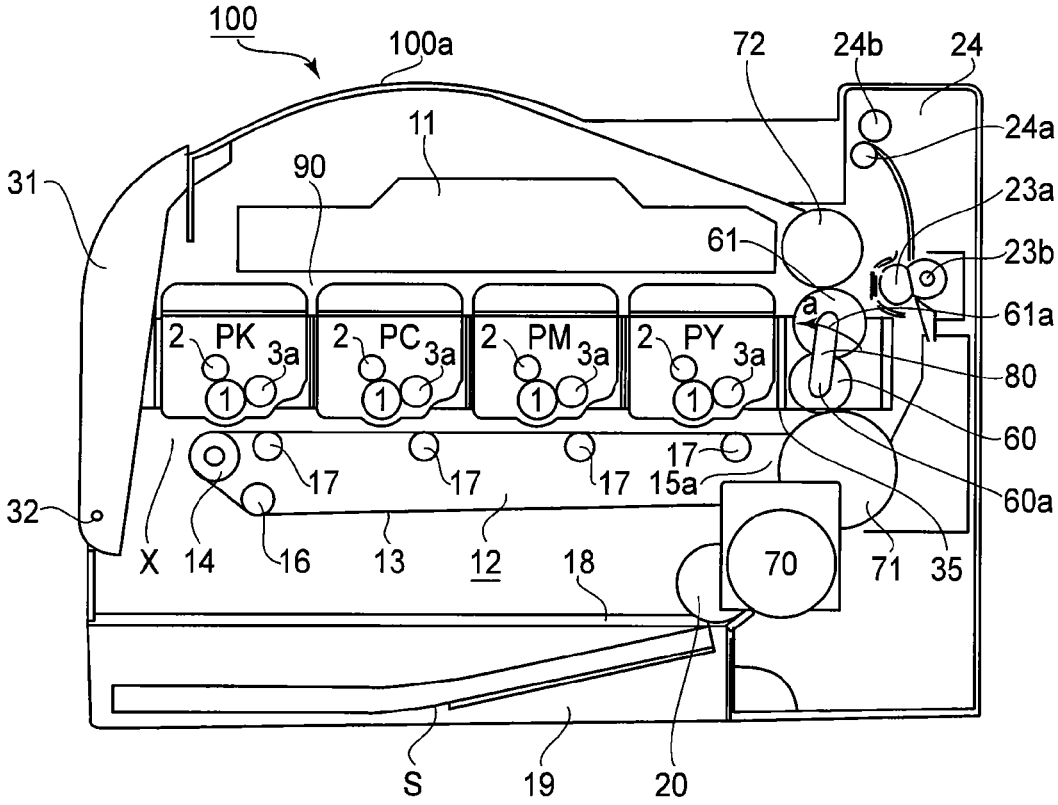
FIG. 9 is a sectional illustration of the driving force transmission constitution when the tray is located at a set position.
Figure 10:
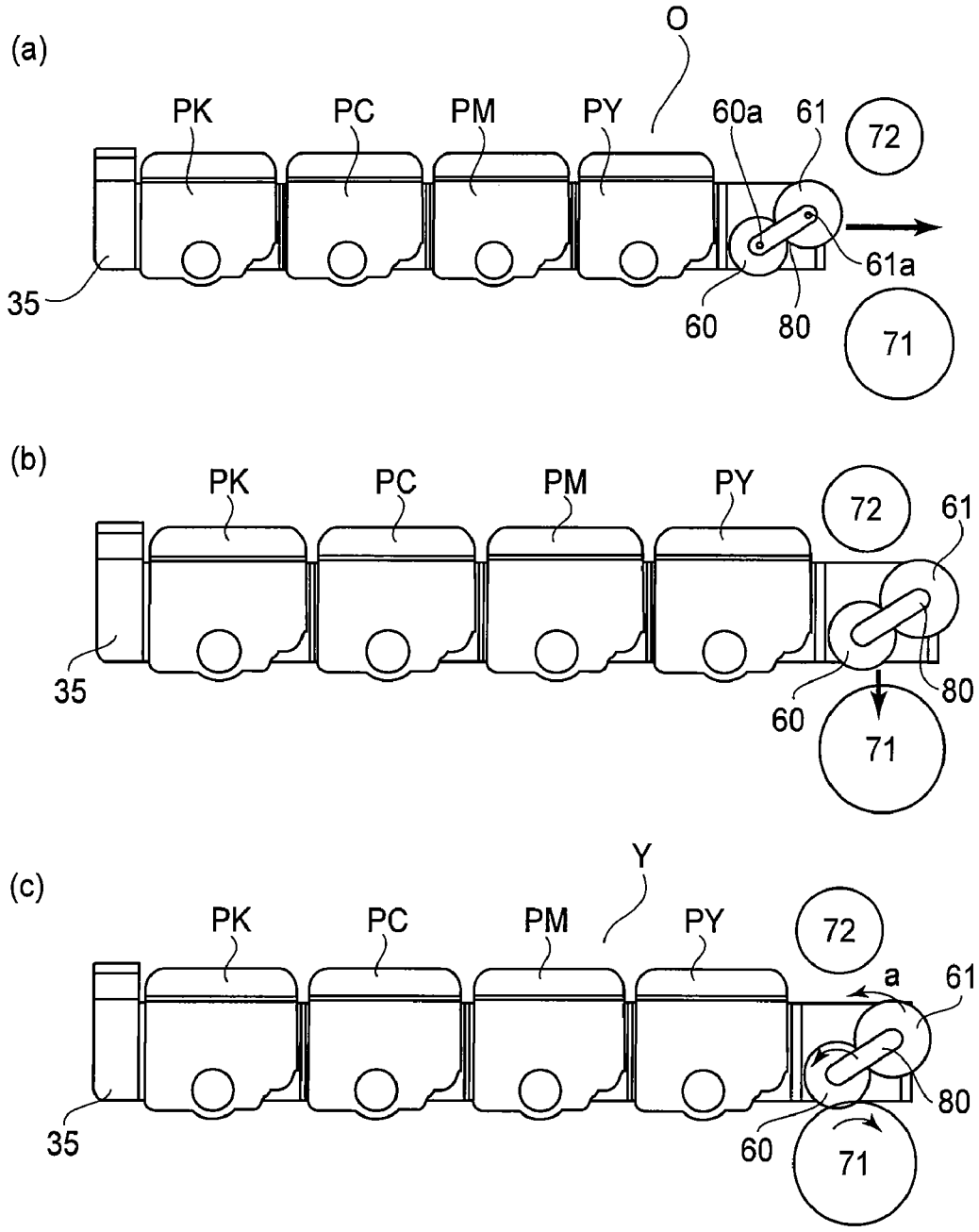
FIG. 10(*a*) is an illustration of the tray when located at the outside position, FIG. 10(*b*) is an illustration of the tray when located at an inside position, and FIG. 10(*c*) is an illustration of the tray when located at the set position.
Figure 11:
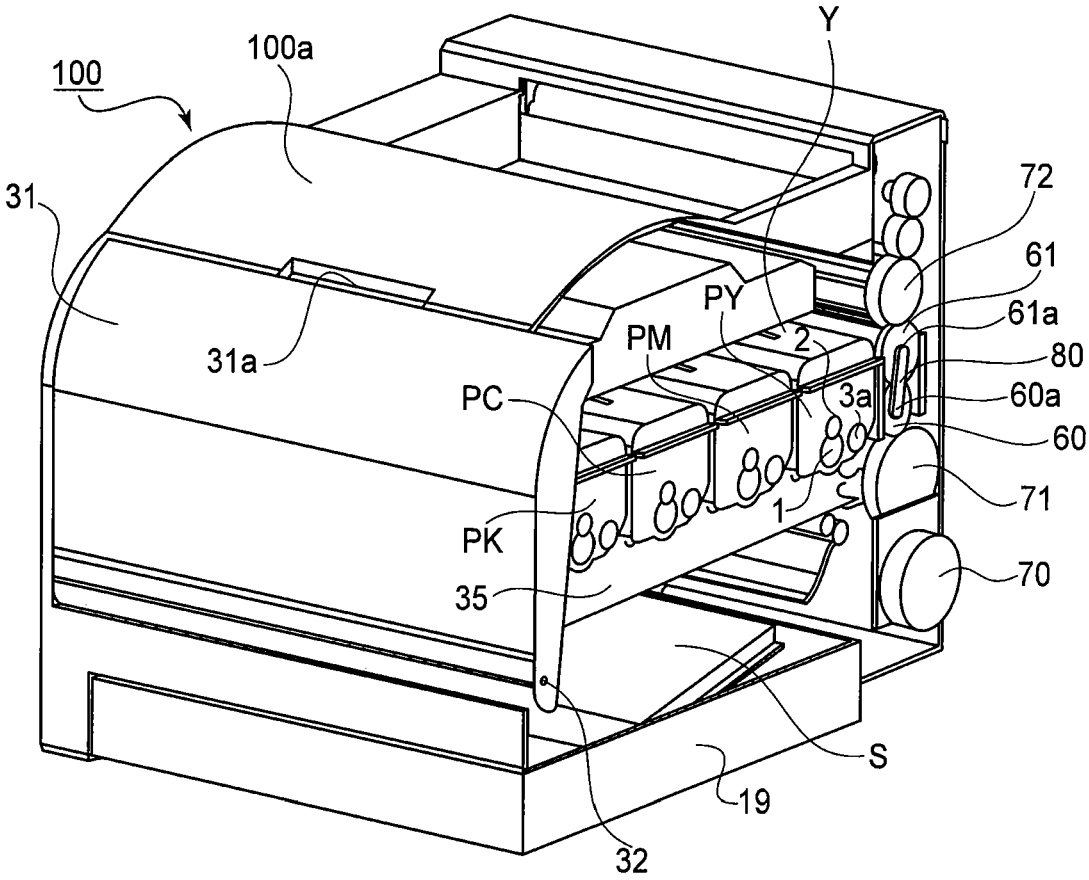
FIG. 11 is a perspective illustration of the driving force transmission constitution when the tray is located at the set position.
Figure 13:
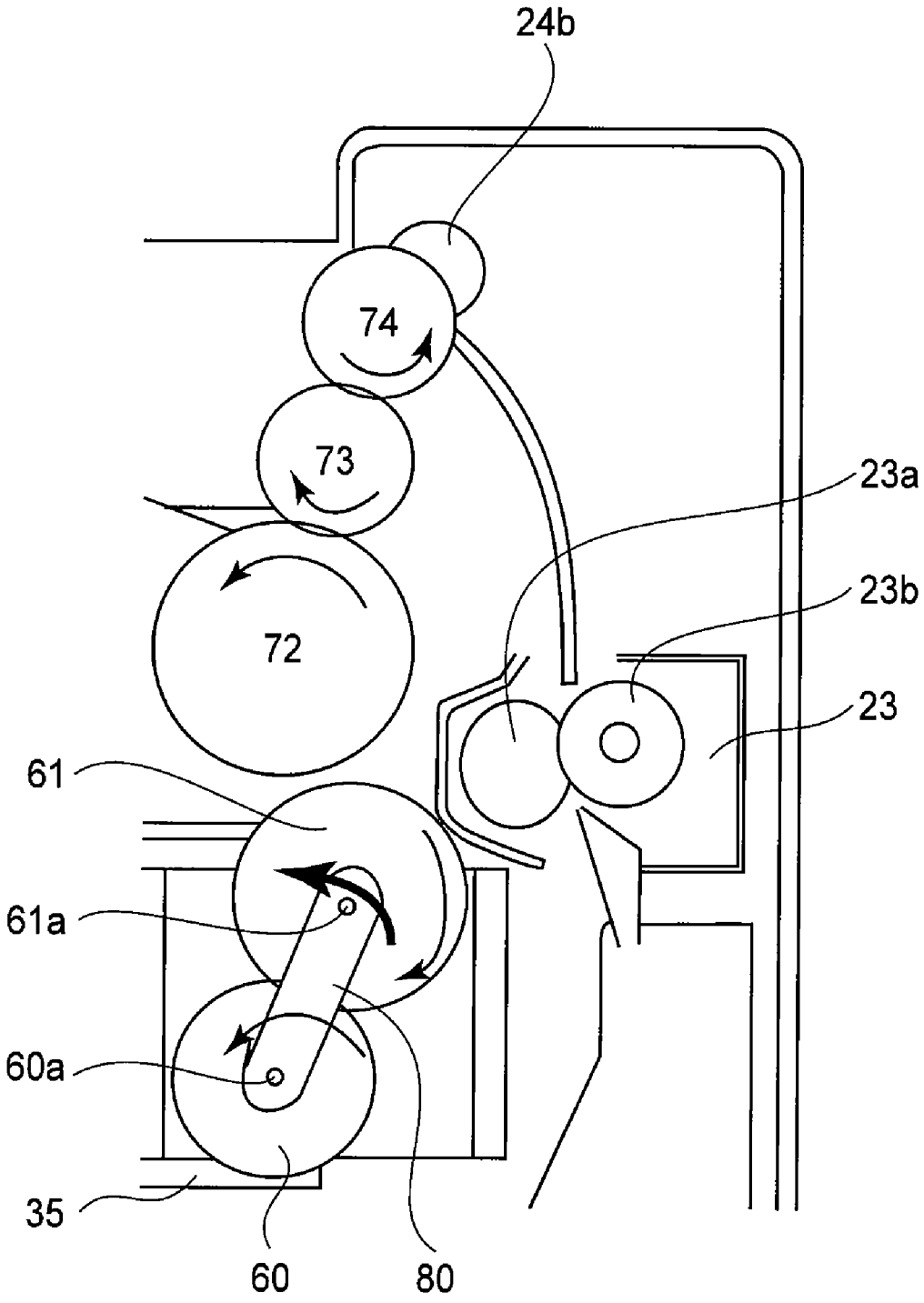
FIG. 13 is an illustration of a pendulum gear downstream side.
Figure 14:
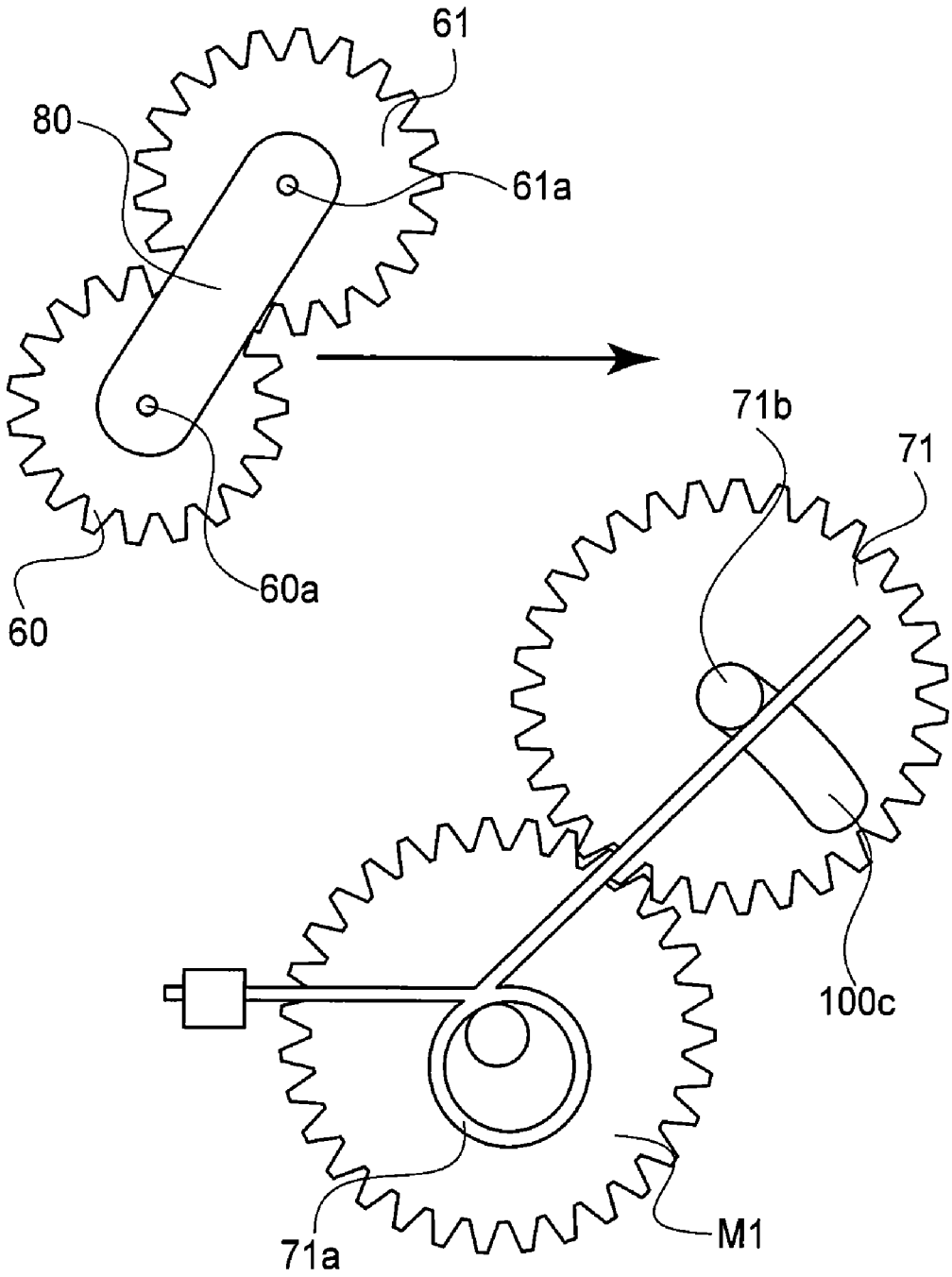
FIG. 14 is an illustration of a swingable constitution of a main assembly side gear.

The image forming apparatus 100*a* of this embodiment is configured so that the driving force (rotating force) can be transmitted from above to below through the mounting space 90 (the tray 35). Here, "above" is above the mounting space 90 (the tray 35) and its extension area and "below" is below the mounting space 90 (the tray 35) and its extension area. The driving force (rotating force) transmission constitution will be described with respect to FIGS. 8 to 14. FIG. 8 is an illustration of a state in which the tray 35 is pulled out and FIG. 9 is an illustration of a state in which the tray 35 is pushed in to the set position Y. FIG. 10(*a*) is an illustration of a tray-side gear and a main assembly-side gear in the case where the tray 35 is located at the outside position O and FIG. 10(*b*) is an illustration of the tray-side gear and the main assembly-side gear in the case where the tray 35 is located at the inside position I. FIG. 10(*c*) is an illustration of the tray-side gear and the main assembly-side gear when the tray 35 is located at the set position Y. FIG. 11 is a perspective view showing a state in which the tray 35 is pushed in to the set position Y and FIGS. 12(*a*) and 12(*b*) are illustrations of a positioning constitution of the tray 35. FIG. 13 is an illustration of driving force transmission constitution at a downstream side of a pendulum gear provided to the tray 35. FIG. 14 is an illustration of a swingable mechanism for connecting the tray-side gear to the main assembly-side gear.

As shown in FIG. 8, at a lower portion of the apparatus main assembly 100, a motor (driving source) 70 is provided. A driving force (rotating force) of the motor 70 is transmitted to a driving member (the discharging roller pair 25 in this embodiment) located at an upper portion of the apparatus main assembly 100 through a gear train. For this purpose, at the lower portion of the apparatus main assembly 100, the motor 70 and a first gear (first driving force transmission member) 71 connected to the motor 70 is provided. The gear 71 transmits the driving force of the motor 70. That is, in the apparatus main assembly 100, the motor 70 is located at the lower portion and the discharging roller pair 24 is located at the upper portion. In this embodiment, a constitution for transmitting the rotating force of the motor 70 to the discharging roller pair 24 can be simplified. Further, the rotating force can be transmitted with reliability.

Through the mounting space 90, a second gear (second driving force transmission member) 72 is disposed on the upper side of the first gear 71. The second gear 72 is driving-connected to a predetermined driving member such as a gear (not shown) provided integrally with one roller 24*a* of the discharging roller pair 24 (FIGS. 8, 9 and 13). When the driving force is transmitted to the second gear 72, the roller 24*a* is rotated. The roller 24*b* press-contacting the roller 24*a* is also rotated by the rotation of the roller 24*a*. As a result, the sheet S on which the image is formed passes through the nip between the roller pair 24 to be sent to the discharging tray 25. The second gear 72 is located substantially right above the first gear 71 and is located at a position separated from the first gear 71 through the mounting space 90. Therefore, in this state, the driving force of the first gear 71 is not transmitted to the second gear 72. The discharging roller pair 24 is provided oppositely to the motor 70 through the tray 35 in a state in which the tray 35 is located at the set position Y. The second gear 72 is provided oppositely to the motor 70 through the first gear 71 in the state in which the tray 35 is located at the set position Y. As described above, intermediary gears 60 and 61 are connected, in the state in which the tray 35 is located at the set position Y, to the first and second gears 71 and 72 to transmit the driving force from the motor 70 to the discharging roller pair 24.

In this embodiment, in order to transmit the driving force of the first gear 71 to the second gear 72, the tray 35 is provided with the intermediary gears (third driving force transmission member) 60 (third gear) and 61 (fourth gear). The intermediary gears 60 and 61 are engaged with each other and the gear 61 is swingable with respect to the gear 60. These gears 60 and 61 are constituted as a so-called pendulum gear. That is, one gear 60 is rotatably mounted to the tray 35 and the other gear 61 is rotatably mounted to an arm (supporting member) 60 swingable about a rotation shaft 60*a* (FIG. 10(*a*)) of the gear 60. That is, the arm 80 rotates about the rotation shaft 60*a* of the gear 60. The gear 61 is provided to an end portion of the arm 80. Further, the gears 60 and 61 is kept in a mesh state.

The gears 60 and 61 are disposed on a leading end side on the tray 35 and at the side surface of the tray 35. The side surface is one of side surfaces of the tray 35 with a line, connecting these side surfaces, perpendicular to a movement direction of the tray 35 moved between the inside position I and the outside position O. The leading end side is a leading end side with respect to a direction in which the tray 35 is moved from the outside position O to the inside position I (i.e., the push-in direction). More specifically, the gears 60 and 61 are mounted to a position in which the first gear 71 and the second gear 72 are to be connected, when the tray is moved to the set position Y in which the cartridge P is to be located at the image forming position X. That is, the gears 60 and 61 are mounted to the tray 35 so that the gear 60 can be engaged with the first gear 71 and the gear 61 can be engaged with the second gear 72. After the cartridge P is exchanged, during a process in which the tray 35 is pushed in to the set position Y, the gear 60 provided to the tray 35 is to be engaged with the first gear 71 provided to the main assembly 100 (from FIG. 10(*a*) to FIG. 10(*b*)). At this time, the first gear 71 is, as shown in FIG. 14, urged against the main assembly side in a swingable state by an elastic force of a spring (elastic member) 71*a*. Then, when the tray 35 is pushed in to the set position Y, the gear 71 is engaged with the gear 60 provided to the tray 35 with reliability (FIG. 10(*c*)). Further, the gear 61 provided to the tray 35 is engaged with the second gear 72 provided to the main assembly 100. As a result, the first gear 71 and the second gear 72 are driving-connected to each other. The driving force of the motor 70 is transmitted to the second gear 72 via the first gear 71 and the intermediary gears 60 and 61. Then, the roller pair (driving member) 24 driving-connected to the second gear 72 is driven. A gear M1 (FIG. 14) is rotated integrally with the motor 70. The rotating force of the motor 70 is transmitted to the gear 71 via the gear M1. The rotation shaft 71*b* of the gear 71 is engaged in an arcuate elongated groove 100*c* provided to the main assembly 100 and is urged to the mounting space 90 side by the elastic force of the spring 71*a*. Therefore, the gear 71 is movable with a range of the groove 100*c* against the elastic force. The rotation shaft 71*b* of the first gear (first driving force transmission member) 71 is engaged in the elongated groove 100*c* and is urged, by the elastic force of the spring (elastic member) 71*a*, toward the tray 35 located at the set position Y.

During the movement of the tray 35 toward the set position Y, as described above, the gear 60 is engaged with the first gear 71 and the gear 61 is engaged with the second gear 72. In this case, first, the gear 60 and the first gear 71 are engaged with each other. Thereafter, the gear 61 is swung in a direction indicated by an arrow a (FIGS. 9 and 10(*c*)). As a result, the gear 61 and the second gear 72 are engaged with each other. Thus, the intermediary gears 60 and 61 provided to the tray 35 are engaged with the first and second gears 71 and 72, respectively, with different timings, so that engagement between the intermediary gear 60 and the first gear 71 and that between the intermediary gear 61 and the second gear 72 are ensured with reliability. According to this embodiment, the gear 61 is swingably provided by the arm 80 and the gear 71 is swingably provided in the range of the groove 100*c*. As a result, when the tray 35 enters the main assembly 100, it is possible to alleviate a degree of impact at the time of engagement between the gears 60 and 71 and engagement between the gears 61 and 72. Even in the case where the position of the tray 35 varies when the tray 35 is located at the set position Y, it is possible to ensure the engagement between the gears 60 and 71 and the engagement between the gears 61 and 72 with reliability. Therefore, according to this embodiment, the rotating force of the motor 70 can be transmitted to the roller pair (driving member) 24 with reliability via the gears M1, 71, 60, 61, and 72.

In this embodiment, as the driving member, the roller pair 24 is described as the example but the driving member is not limited to the roller pair 24. For example, as the driving member, it is possible to use a fixing roller pair (the fixing roller 23*a* and the pressing roller 23*b*), a conveying roller pair (not shown), or the like.

The set position Y is located inside the main assembly 100 and is a position in which the cartridge P is located at the image forming position X in which the cartridge P effects image formation.

The pendulum gear 61 is rotatably mounted to the arm 80 by mounting the rotation shaft 61*a* thereof to one end portion of the arm 80. Further, by mounting the rotation shaft 60*a* of the gear 60 to the other end portion of the arm 80, the gear 60 is rotatably mounted. In a state in which the gear 61 is mounted to one end side of the arm 80 and the gear 60 is rotatably mounted to the other end side of the arm 80, the center shaft 60*a* is rotatably mounted to the side surface of the tray 35. As a result, the arm 80 is swung about the center shaft 60*a*. When the tray 35 reaches the set position Y or in the process in which the tray 35 reaches the set position Y, the gear 60 engages with the gear 71. By the rotation of the gear 71, the arm 80 is rotated about the center shaft 60*a* in the direction indicated by the arrow a (FIG. 9). Then, the gear 61 engages with the gear 72. As a result, the rotating force of the motor 70 is transmitted to the roller pair (driving member) 24 through the gears 71, 60, 61, and 72. When the rotation of the gear 71 is stopped, by the elastic force of the spring (not shown), the arm 80 is rotated about the center shaft 60*a* in a reverse direction of the arrow a direction (FIG. 9). As a result, the gears 71 and 60 are disengaged from each other.

Figure 12:
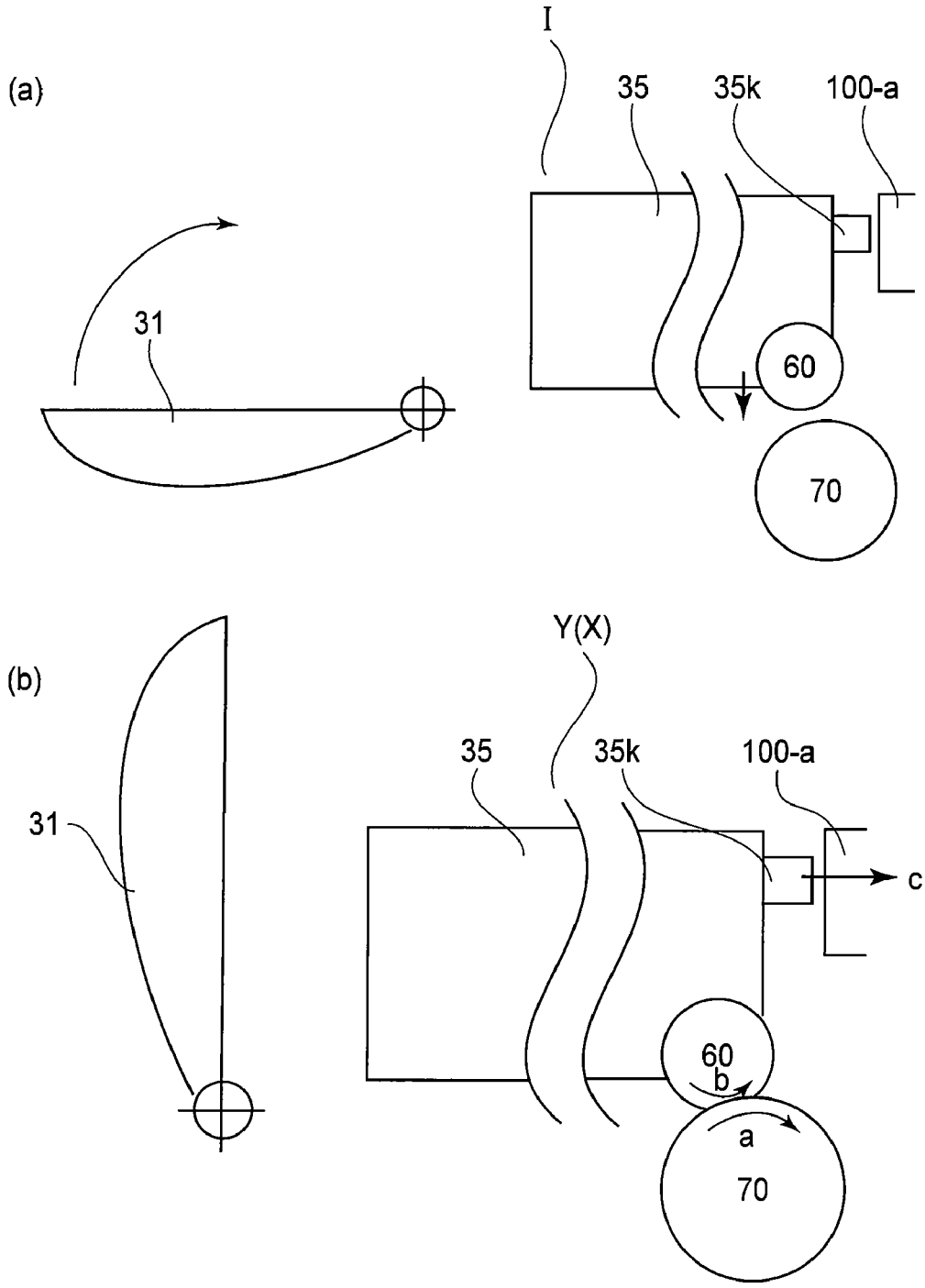
FIG. 12(*a*) is a schematic illustration of an end of the tray and an abutting portion of an apparatus main assembly when the tray is located at the inside position, and FIG. 12(*b*) is a schematic illustration of the end of the tray and the abutting portion of the apparatus main assembly when the tray is located at the set position.

As shown in FIG. 12(*a*), when the tray 35 is pushed into the inside position I, the tray 35 is positioned (fixed) on the main assembly side by a latch (not shown) provided to the tray 35. Thereafter, when the door 31 is closed, the tray 35 is pushed into the set position Y.

In this embodiment, as shown in FIG. 12(*b*), when the rotating force is transmitted from the motor 70 to the intermediary gear 60, the rotating force acting on the gear 60 acts on the tray 35 so as to be moved in the direction in which the tray 35 is pushed into the main assembly 100.

More specifically, as shown in FIG. 12(*b*), when the motor 70 is driven (rotated), to the first gear 71 (not shown in FIG. 12(*b*)), the rotating force with respect to the clockwise direction (the arrow a direction) is transmitted. Then, to the intermediary gear 60 engaged with the gear 71, the rotating force with respect to the counterclockwise direction (an arrow b direction) is transmitted. At this time, a force for sliding the tray 35 in an arrow c direction is exerted from the gear 71 onto the ray 35. For this reason, when the rotating force is transmitted to the gear 60, the force is exerted on the tray 35 so that the abutting portion 35*k* always abuts against the contact portion (positioning portion) 100-*a*. That is, during the image formation, the force acts on the tray 35 to that the abutting portion 35*k* always abuts against the contact portion (positioning portion) 100-*a*. As a result, the tray 35 is accurately positioned with respect to the apparatus main assembly 100. The abutting portion 35*k* is provided to the tray 35 at an end of the tray 35 with respect to the direction in which the tray 35 is pushed in. The contact portion 100-*a* is provided to the main assembly 100. Further, to the tray 35, the abutting portion 35*k* is provided at the end of the tray 35 with respect to the direction in which the tray 35 is pushed in from the outside position O to the inside position I. When the driving force is transmitted to the gear (the third driving force transmission member) 60, the force acting on the gear 60 is exerted so that the tray 35 is moved in the direction in which the abutting portion 35*k* abuts against the contact portion 100-*a*. This constitution can be applied to also other embodiment.

As described above, in this embodiment, through the gears 60 and 61 provided to the tray 35, the rotating force can be transmitted from the gear 71 provided below the tray 35 to the gear 72 provided above the tray 35. In this embodiment, as the driving force transmission member, the gears are described as an example but the driving force transmission member is not limited to the gears. For example, as the driving force transmission member, it is possible to use also a toothed belt or the like.

Second Embodiment

An image forming apparatus according to Second Embodiment will be described with reference to FIGS. 15 to 19. A basic constitution of the apparatus of this embodiment is identical to that in First Embodiment, thus being omitted from redundant description. The description will be made with respect to a characterizing feature of a constitution of this embodiment. Further, members or portions having the same functions as those in First Embodiment are represented by identical reference numerals or symbols.

As shown in FIG. 15, the tray 35 in this embodiment is provided with the intermediary gears (the third driving force transmission member) 62 and 63 (third gear) and 67 (fourth gear) for driving-connecting the first gear 71 to the second gear 72. Further, the tray 35 is provided with developing roller driving gears 64 (64-1, 64-2, 64-3, 64-4) for rotating the developing roller 3*a* and door driving gears 65 (65-1, 65-2, 65-3, 65-4) for rotating the photosensitive drum 1.

That is, a pair of gears is vertically provided on the side surface of the tray 35 at a position in which each cartridge P is located. At the lower portion of the side surface of the tray 35, the door driving gears (the driving force transmission member) 65-1, 65-2, 65-3 and 65-4 for transmitting the rotating force to the photosensitive drum 1 of each of the four cartridges supported by the tray 35 are provided in the engaged state through the intermediary gears 67. That is, the gears 67 are disposed between the gears 65-1 and 65-2, the gears 65-2 and 65-3, and between the gears 65-3 and 65-4.

Further, at the upper portion of the side surface of the tray 35, the developing roller driving gears (the driving force transmission member) 64-1, 64-2, 64-3 and 64-4 for transmitting the rotating force to the developing roller 3*a* of each of the four cartridges supported by the tray 35 are provided in the engaged state through the intermediary gears 66. That is, the gears 66 are disposed between the gears 64-1 and 64-2, the gears 64-2 and 64-3, and between the gears 64-3 and 64-4.

Figure 19:
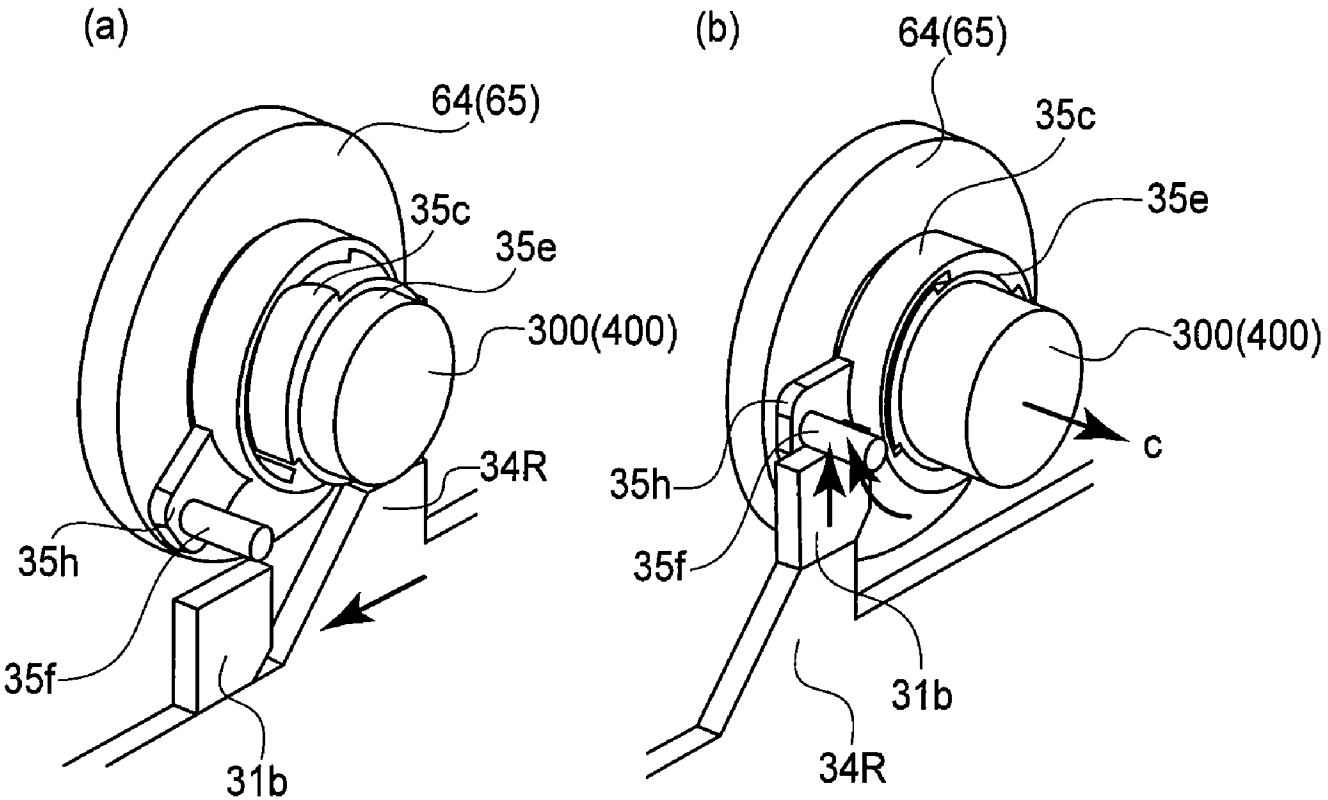
FIGS. 19(*a*) and 19(*b*) are illustrations of couplings.
Figure 20:
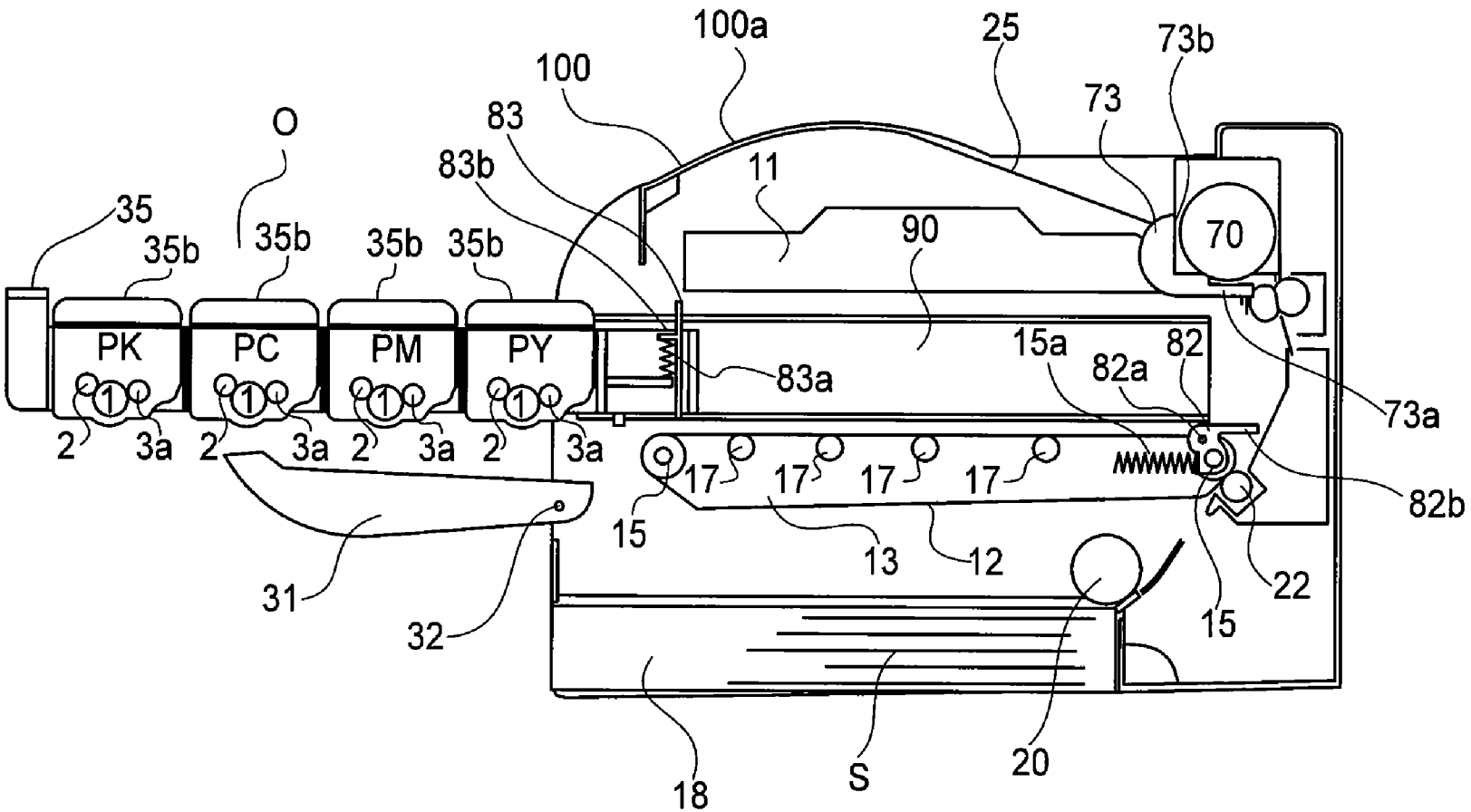
FIG. 20 is a sectional illustration of a driving force transmission constitution when a tray in Third Embodiment is located at the cartridge mounting and demounting position.
Figure 21:
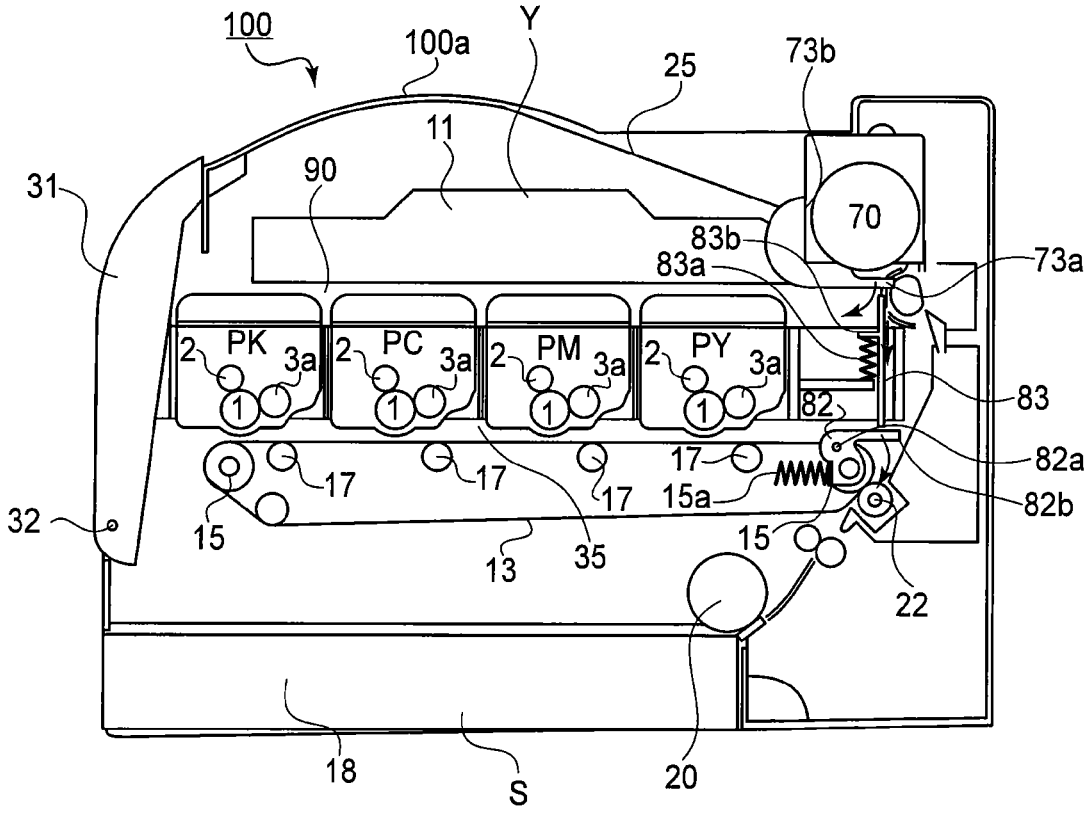
FIG. 21 is a sectional illustration of the driving force transmission constitution when the tray in Third Embodiment is located at the set position.

In this embodiment, when each cartridge P is mounted to (supported by) the tray 35, each photosensitive drum 1 and each developing roller 3*a* are driving-connected to the above-described driving gears. In this case, as shown in FIGS. 19(*a*) and 19(*b*), the tray 35 is provided with a cam 35*c*, a cylindrical portion 35*h* having a contacting and separating lever, and the gear 64 for transmitting the driving force to the cartridge P. That is, the cam 35*c*, the cylindrical portion 35*h*, a cylindrical portion 35*e*, and the main assembly-side developing device coupling 300 are provided coaxially with the gear 64.

The gear 64 and the cylindrical portion 35*h* are integrally provided, thus being integrally slidable in their axial direction. The main assembly 100 is provided with the rail 34R interrelated with the opening and closing of the door 31. When the door 31 is moved in the closing direction, the rail 34R upwardly moves a vertically movable pop-up member 31*b* provided to the main assembly 100 (from FIGS. 19(*a*) to 19(*b*)). When the pop-up member 31*b* moves upwardly, the pop-up member 31*b* pushes up a dowel 35*f*. As a result, the cylindrical portion 35*h* provided integrally with the dowel 35*f* is rotated in the counterclockwise direction (FIG. 19(*b*)). As a result, a groove provided to the cylindrical portion 35*h* runs upon the cam 35*c*. As a result, the gear 64 and the cylindrical portion 35*e* which are urged toward an arrow c direction are moved in the arrow c direction (FIG. 19(*b*)). Thus, the main assembly-side developing device coupling 300 provided to the cylindrical portion 35*e* is moved toward the tray 35 side. Then, the coupling 300 engages with the developing device coupling 54. In this way, the rotating force (the driving force) is transmitted from the main assembly 100 to the developing roller 3*a*.

With reference to FIGS. 19(*a*) and 18(*b*), the embodiment in which the rotating force is transmitted from the main assembly 100 to the developing roller 3*a* is described but the constitution for transmitting the driving force to the door 1 is similarly configured. That is, the gear 64 may only be replaced with the gear 65 and the coupling 300 may only be replaced with the main assembly-side door coupling 400. The main assembly-side coupling is moved forward and rearward in a direction perpendicular to the movement direction of the tray 35 in interrelation with the opening and closing of the door 31. As described above, the gear train 65-1 to 65-4 and the gears 67 transmit the rotating force to the door 1. Further, the gear train 64-1 to 64-4 and the gears 66 transmit the rotating force to the developing roller 3*a*. These gears 65-1 to 65-4 and 67 and the gears 64-1 to 64-4 and 66 are the third driving force transmission member.

The tray 35 is successively provided with the intermediary gears (the third driving force transmission member) 62, 63 and 67 in the engaged state. That is, the gear 62 and the door driving gear 65-1 are engaged with each other and the gear 63 and the developing roller driving gear 64-1 are engaged with each other. The gear 63 and the gear 67 are configured as the pendulum gear. That is, the gear 67 is rotatably mounted to the arm 81 swingable about a rotation shaft 63*a* (FIGS. 15 to 18) of the gear 63. The arm (supporting member) 81 is swingably mounted to the side surface of the tray 35. That is, the arm 81 is rotated about the rotation shaft 63*a* of the gear 63. The gear 67 is provided at an end portion of the arm 81. The gear 63 and the gear 67 are kept in the mesh state.

Figure 17:
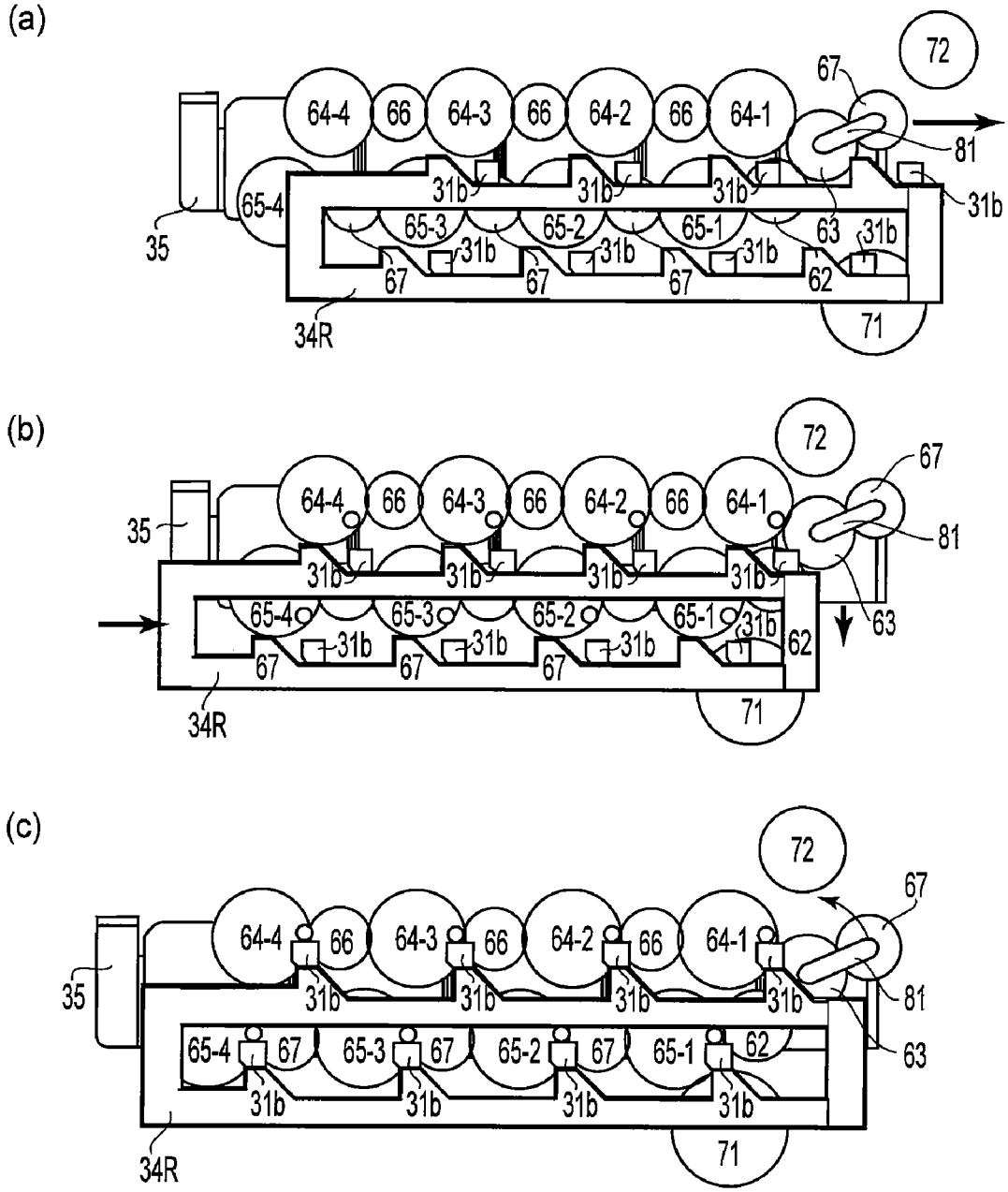
FIGS. 17(*a*) to 17(*c*) are illustrations of the tray in Second Embodiment, wherein the tray is located at the outside position (FIG. 17(*a*)), at the inside position (FIG. 17(*b*)), and at the set position (FIG. 17(*c*)).
Figure 18:
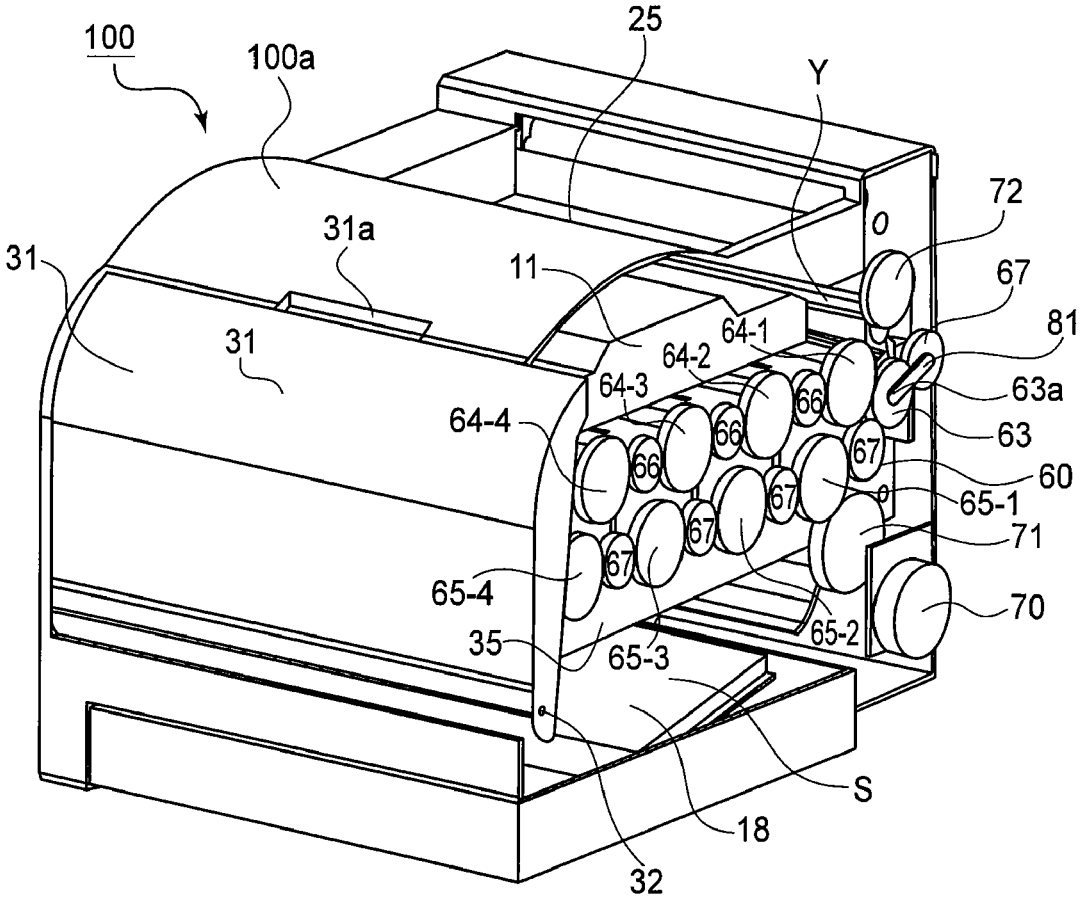
FIG. 18 is a perspective illustration of the driving force transmission constitution when the tray in Second Embodiment is located at the set position.

When the tray 35 provided with the above-described gear train is further pushed in from the inside position I to the set position Y, as shown in FIGS. 17(*a*), 17(*b*) and 17(*c*), the first gear 71 engages with the gear 65-1. Thereafter, the intermediary gear 67 rotates in the counterclockwise direction to engage with the second gear 72. For this reason, when the tray 35 is located at the set position Y, the driving force of the first gear (the first driving force transmission member) 71 is transmitted to the second gear 72 via the gear 65-1 and the intermediary gears 62, 63 and 67. Also in this embodiment, the second gear 72 is driving-connected to, e.g., the discharging roller pair 24 shown in FIG. 13. Thus, when the driving force is transmitted to the second gear 72, the discharging roller pair 24 is rotated.

By the rotating force transmitted from the gear 71 to the respective gears 65, the couplings 400 are rotated, so that the respective photosensitive drums 1 are rotated through the couplings 53. Similarly, by the rotating force transmitted from the gear 63 to the respective gears 64, the couplings 300 are rotated, so that the respective developing rollers 3*a* are rotated through the couplings 54.

In this way, by providing the gears 64 and the gears 65 to the tray 35 supporting the cartridges P, the rotating force transmission constitution in the apparatus main assembly 100 becomes easier, so that the apparatus can be downsized.

Also in this embodiment, the first gear 71 is, as shown in FIG. 14, urged toward the space 90 side (the main assembly 100 side) in a swingable state by the elastic force of the spring 71*a*. When the tray 35 is pushed in the set position Y, the gear 71 is engaged with the gear 60 with reliability. Further, the intermediary gear 67 is the pendulum gear. For this reason, the gears 65-1 and 67 are engaged with the first and second gears 71 and 72 provided to the apparatus main assembly 100 with different timings. As a result, engagement between the gears 65-1 and 71 and that between the gears 67 and 72 are ensured with reliability. In this embodiment, the gears 64 and 65 are schematically illustrated in an enlarged manner in the figures. However, in an actual image forming apparatus, at the side surface of the tray 35, a space in which the main assembly-side couplings can move forward and rearward and can engage with the cartridge-side couplings is ensured. Further, in this embodiment, as the driving force transmission member, the gears are described as an example but the driving force transmission member is not limited to the gears. As the driving force transmission member, it is also possible to employ a toothed belt or the like.

Figure 16:
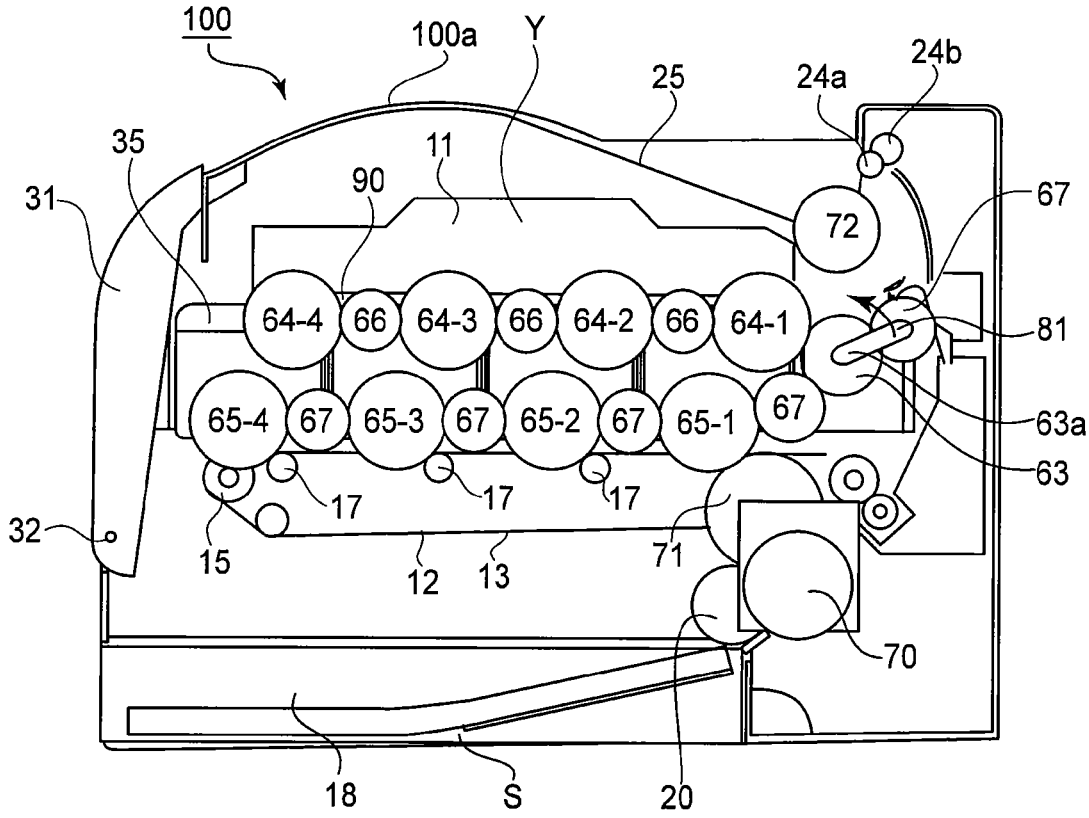
FIG. 16 is a sectional illustration of the driving force transmission constitution when the tray in Second Embodiment is located at the set position.

In the above-described embodiments, when the gears 61 and 72 are connected to each other, the gear 61 is swingably mounted to the tray 35 (FIG. 13). Alternatively, when the gears 67 and 72 are connected to each other, the gear 67 is swingably mounted to the tray 35 (FIG. 16). Further, when the gears 60 and 71 or the gears 63 and 71 are connected to each other, the gear 71 is swingably mounted to the main assembly 100 (FIG. 14). That is, in the above-described embodiments, one of the gears to be connected is swingably provided. However, the embodiments are not limited to such a constitution but may also employ a constitution in which at least one of the engaging gears is swingably provided. For example, it is possible to use the gear swingable constitution described with reference to FIG. 13 or FIG. 16 and that described with reference to FIG. 14 in combination. That is, as desired, both of the gears to be connected may also be mounted swingably. However, as used in the above-described embodiments, when either one of the engaging gears is configured to be swingable, the resultant constitution can be simplified. In the above-described embodiments, in the state in which the tray 35 is located at the set position Y, the first gear (the first driving force transmission member) 71 and the second gear (the second driving force transmission member) 72 are provided oppositely to each other through the tray 35. Further, in the state in which the tray 35 is located at the set position Y, the motor (the driving source) 70 and the roller pair 24 are provided oppositely to each other through the tray 35. By providing the intermediary gears (the third driving force transmission member) 62, 63 (and 67) to the tray 35, the transmission constitution of the driving force from the motor 70 to the roller pair 24 can be simplified. Here, "provided oppositely to each other through the tray 35" means that a line connecting a part of the constitution of the gear 71 (or the motor 70) and a part of the constitution of the gear 72 (or the roller pair 24) intersects with a part of the tray 35 (the mounting space 90). The tray 35 is movable between the outside position O and the set position Y in the state in which the tray 35 supports the plurality of cartridges.

Third Embodiment

An image forming apparatus according to Third Embodiment will be described with reference to FIGS. 20 to 25. A basic constitution of the apparatus of this embodiment is also identical to that in First Embodiment, thus being omitted from redundant description. The description will be made with respect to a characterizing feature of a constitution of this embodiment. Further, members or portions having the same functions as those in First and Second Embodiments are represented by identical reference numerals or symbols.

In the B above-described embodiments, the driving force is transmitted by transmitting the rotating force to the gear train provided to the tray 35. In this embodiment, as the third driving force transmission member, a driving force transmission member causing linear motion is provided to the tray 35.

Figure 22:
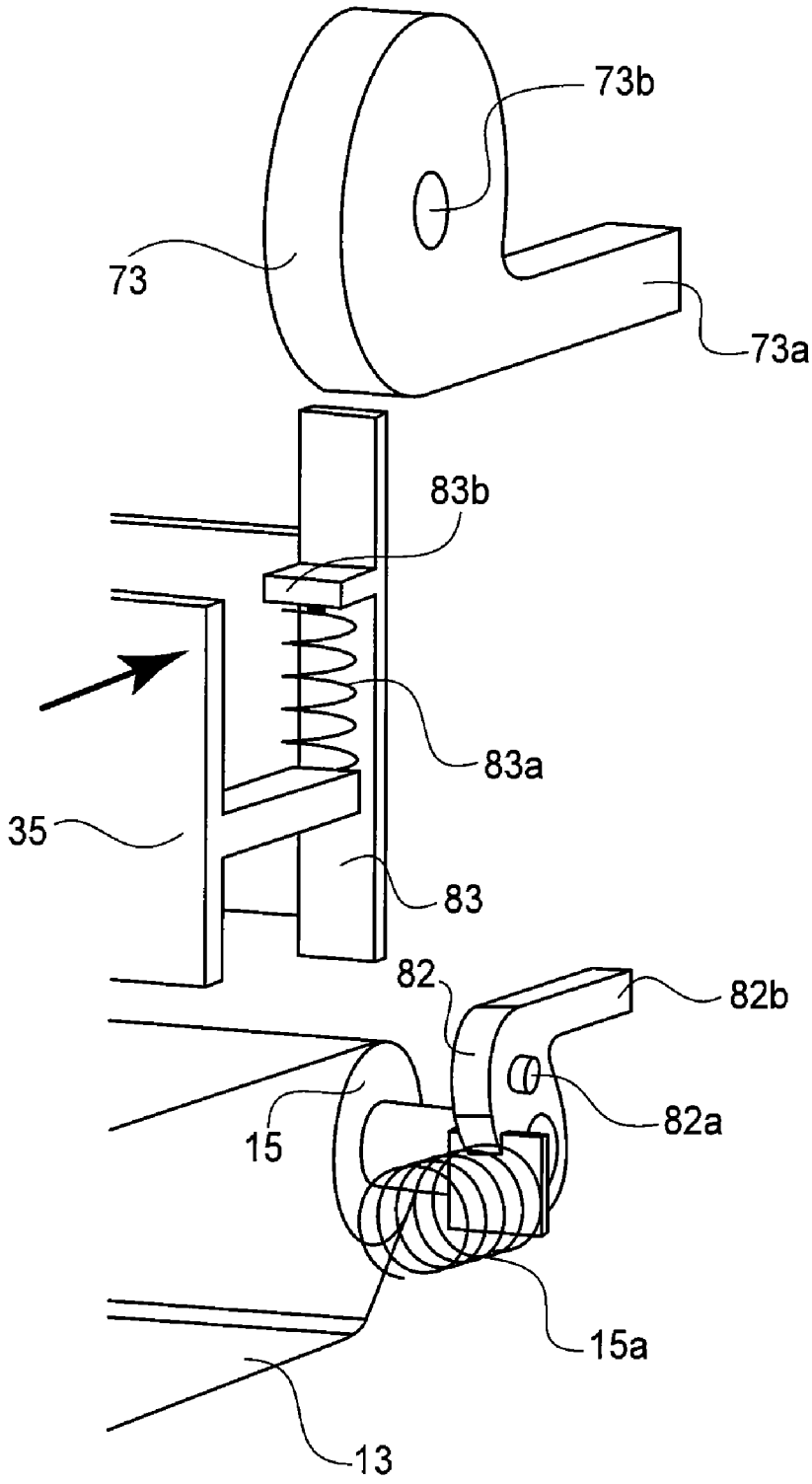
FIG. 22 is an illustration of the tray in Third Embodiment when the tray is located at the outside position.
Figure 23:
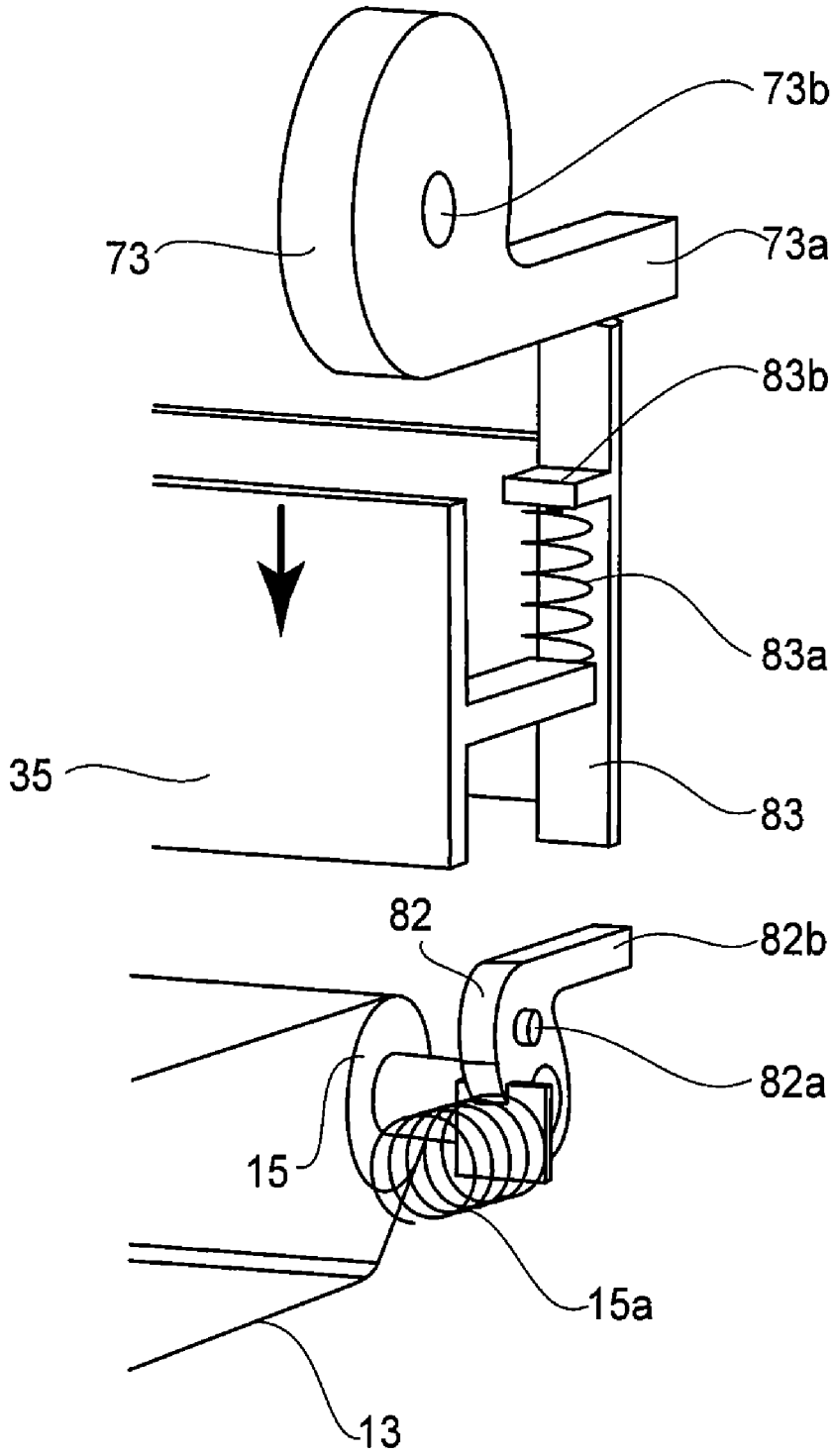
FIG. 23 is an illustration of the tray in Third Embodiment when the tray is located at the inside position.

As shown in FIG. 22, a gear portion 7 to be rotated by the rotating force from the motor 701 is provided to the upper portion of the main assembly 100. A link mechanism member (first driving force transmission member) 73*a* is provided integrally with the gear portion 73. The gear portion 73 and the link mechanism member 73*a* are rotatable about a rotation shaft 73*b*. The link mechanism member 73*a* is swingable about the rotation shaft 73*b* by the drive (rotation) of the motor 70. Below the link mechanism member 73*a* through the mounting space 90, a roller supporting member (second driving force transmission member) 82 is provided. The roller supporting member 82 is provided to the main assembly 100 so as to be swingable about a shaft 82*a*. At one end portion of the supporting member 82, the tension roller 15 is rotatably mounted. At the other end portion of the supporting member 82, an arm portion 82*b* is provided.

The tension roller 15 is urged against the secondary transfer roller 22 by the elastic force of the tension spring (elastic member) 15*a*.

To the tray 35, a driving force receiving and supplying member (third driving force transmission member) 83 is provided along the vertical direction. The member 83 is mounted to the tray 35 slidably in the vertical direction. The member 83 is upwardly urged by the elastic force of an urging spring (elastic member) 83*a* and a stopper portion 83*b* thereof is locked and positioned in a regulating portion (not shown) of the tray 35.

Figure 24:
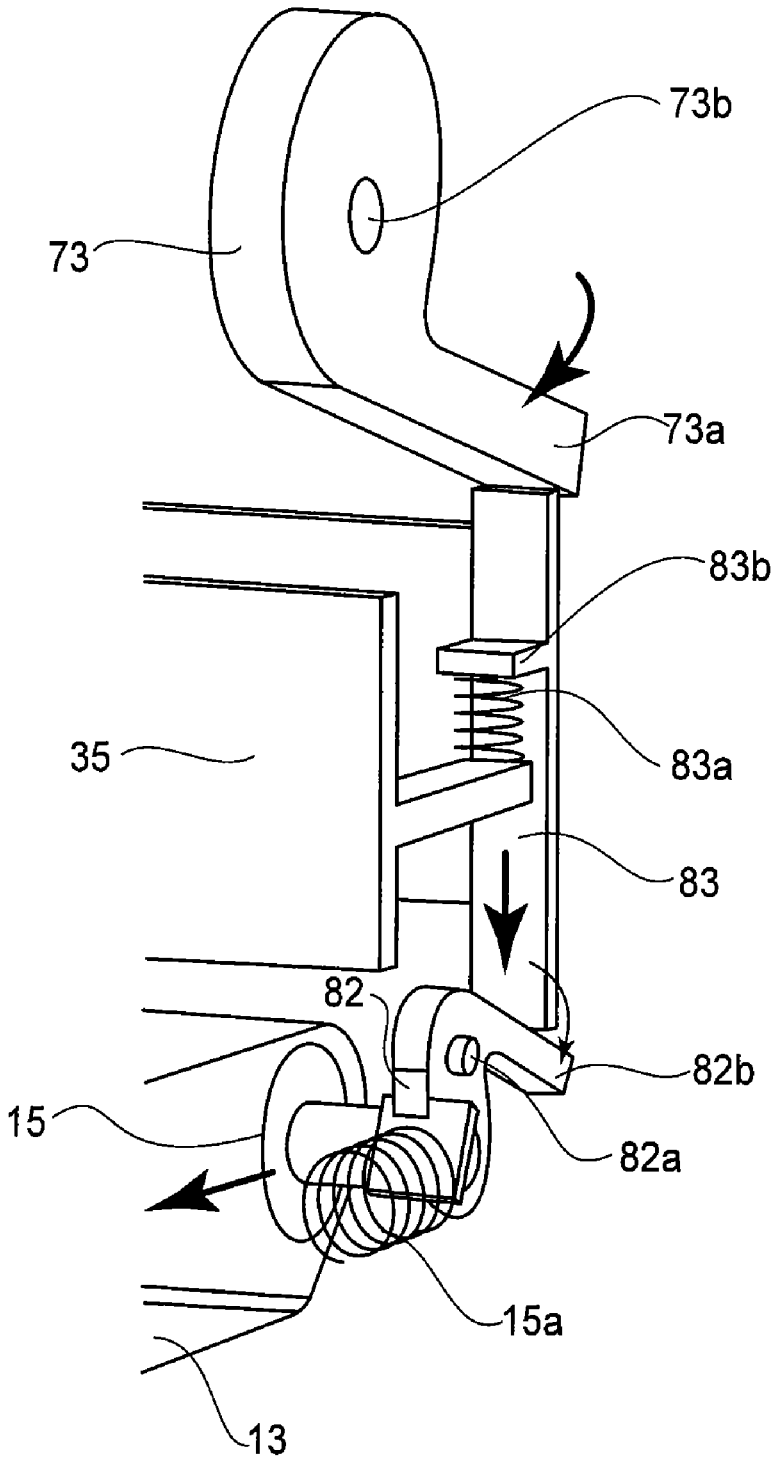
FIG. 24 is an illustration of the tray in Third Embodiment when the tray is located at the set position.
Figure 25:
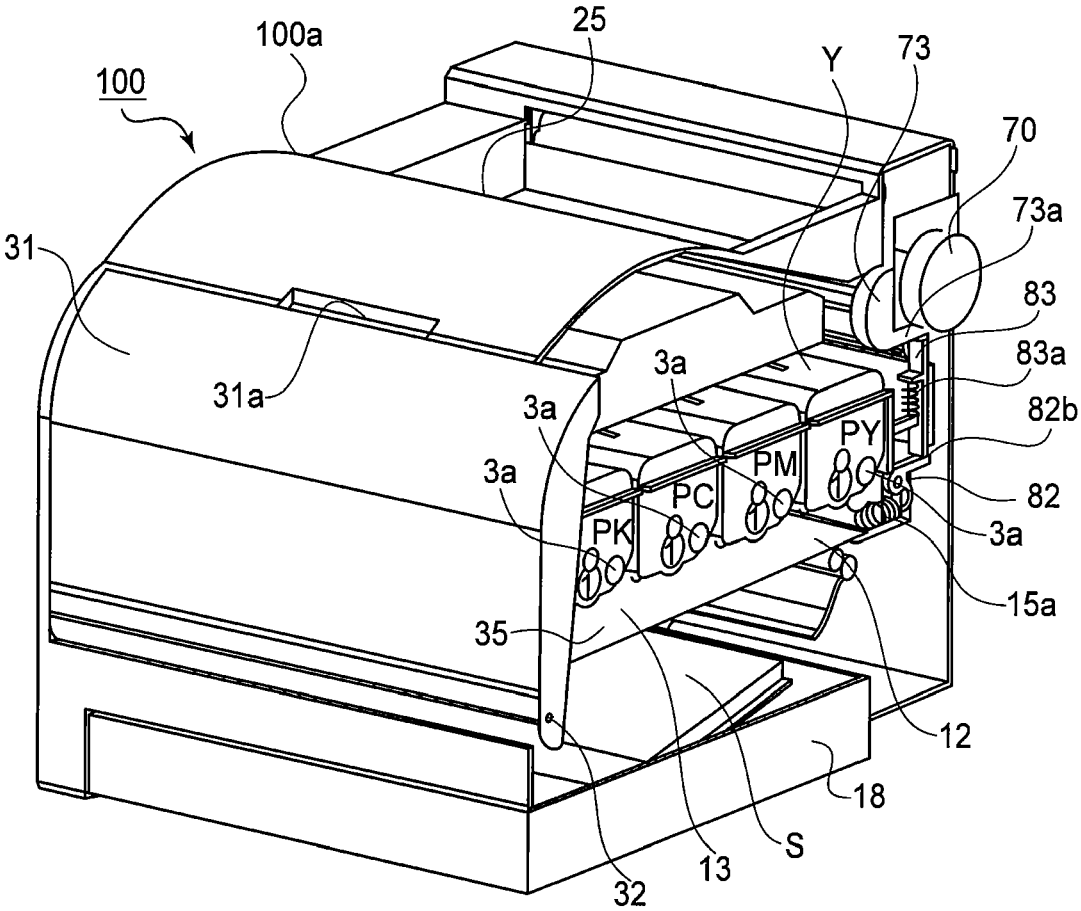
FIG. 25 is a perspective illustration of the driving force transmission constitution when the tray in Third Embodiment is located at the set position.

In the above-described constitution, as shown in FIG. 24, when the tray 35 is pushed in to the set position Y, an upper end of the member 83 faces the link mechanism member 73*a* and a lower end of the member 83 faces the arm portion 82*b*. In this state, when the motor 70 is driven and the link mechanism member 73*a* swings in a direction of an indicated arrow (FIG. 24), the member 83 is downwardly pressed by the link mechanism member 73*a* against the elastic force of the urging spring 83*a*. Thus, by the lower end of the member 83, the arm portion 82*b* is swung in a direction indicated by an arrow (FIG. 24). As a result, the tension roller 15 is moved away from the secondary transfer roller 22.

Thus, when the image forming apparatus 100*a* is placed in a stand-by state for a long time, the tension roller 15 is retracted. As a result, the tension exerted on the belt 13 is released to prevent deformation of the belt 13 such as elongation or the like.

As described above, the rotating force of the motor 70 located at the upper portion of the apparatus main assembly 100 is transmitted to the roller supporting member 82 by the member 83 provided to the tray 35. As a result, the driving force transmission constitution in the apparatus main assembly 100 can be simplified. Further, downsizing of the apparatus can be realized.

The transmission of the driving force to the driving force receiving and supplying member (third driving force transmission member) 83 is based on linear motion. The receiving and supplying member 83 acts in the direction of gravitation.

According to this embodiment, when the tray 35 is moved to the set position Y, the link mechanism member (the first driving force transmission member) 73*a* and the roller supporting member (the second driving force transmission member) 82 are connected by the driving force receiving and supplying member (the third driving force transmission member) 83. For this reason, even in the case where the constitution in which the driving force is transmitted with the position (space) in which the cartridges P are mounted is employed, there is no need to ensure a driving force transmitting path so as to avoid the moving area of the tray 35. Therefore, the driving force transmission constitution in the apparatus main assembly 100 can be made easy. Further, the apparatus can be downsized.

According to the above-described embodiments, in the case of using the tray 35 movable between the inside position I located inside the main assembly 100 and the outside position O located outside the main assembly 100 in the state in which the tray 35 supports the cartridges P, it was possible to realize a simple transmission constitution of the driving force. Further, in the case of using the tray 35, the driving force transmission can be performed without increasing the size of the apparatus. Further, by providing the driving force transmission members to the tray 35, it was possible to realize simplification of the driving force transmission constitution.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 253338/2008 filed Sep. 30, 2008 and 216947/2009 filed Sep. 18, 2009, which are hereby incorporated by reference.

What is claimed is:

1. A color electrophotographic image forming apparatus for forming an image on a recording material, wherein a plurality of cartridges is detachably mountable to a main assembly of said image forming apparatus, said apparatus comprising:

a cartridge supporting member for supporting the cartridges, said cartridge supporting member being movable between a set position, inside the apparatus main assembly, in which the cartridges are to be located at an image forming position in which the cartridges effect image formation, and an outside position, outside the apparatus main assembly, in which the cartridges are mountable to and demountable from said cartridge supporting member;

a driving source;

a driving member provided at a position in which said driving member opposes said driving source through said cartridge supporting member in a state in which said cartridge supporting member is located at the set position;

a first driving force transmission member for transmitting a driving force of said driving source;

a second driving force transmission member provided at a position in which said second driving force transmission member opposes said first driving force transmission member through said cartridge supporting member in the state in which said cartridge supporting member is located at the set position, wherein said second driving force transmission member transmits the driving force to said driving member; and a third driving force transmission member provided to said cartridge supporting member, wherein said third driving force transmission member is, in the state in which said cartridge supporting member is located at the set position, connected to said first and second driving force transmission members to transmit the driving force of said driving source to said driving member, wherein when said third driving force transmission member is connected to said first driving force transmission member, at least one of said third and first driving force transmission members is swingably provided, and wherein when said third driving force transmission member is connected to said second driving force transmission member, at least one of said third and second driving force transmission member is swingably provided.

2. An apparatus according to claim 1, wherein said third driving force transmission member includes a gear and includes another gear provided to a supporting member rotatable about a rotation shaft of the gear, the gear and another gear being kept in an engaging state.

3. An apparatus according to claim 2, wherein said first driving force transmission member is a gear and a rotation shaft thereof is engaged in an elongated groove, the gear being urged by an elastic force of an elastic member toward a direction in which said cartridge supporting member located at the set position is provided.

4. An apparatus according to claim 3, wherein the apparatus main assembly is provided with a positioning portion and said cartridge supporting member is provided with an abutting portion at an end of said cartridge supporting member with respect to a push-in direction in which said cartridge supporting member is moved from the outside position to the inside position, and wherein when the driving force is transferred to said third driving force transmission member, an acting force acts on said third driving force transmission member so that said cartridge supporting member moves toward a door in which the abutting portion of said cartridge supporting member abuts against the positioning portion.

5. An apparatus according to claim 2, wherein said third driving force transmission member further includes a gear train for transferring the driving force to a photosensitive drum and a developing roller which are provided to said cartridge.

6. An image forming apparatus for forming an image on a recording material, said apparatus comprising:

a cartridge supporting member for supporting a cartridge, said cartridge supporting member being movable between a set position, inside the apparatus main assembly, in which the cartridge is to be located at an image forming position in which the cartridge effects image formation, and an outside position, outside the apparatus main assembly, in which the cartridge is mountable to and demountable from said cartridge supporting member;

a first driving force transmission member for transmitting a driving force of a driving source;

a second driving force transmission member provided at a position in which said second driving force transmission member opposes said first driving force transmission member through said cartridge supporting member in a state in which said cartridge supporting member is located at the set position, wherein said second driving force transmission member transmits the driving force to said driving member; and a third driving force transmission member provided rotatably and movably to said cartridge supporting member, wherein said third driving force transmission member is, in the state in which said cartridge supporting member is located at the set position, connected to said first and second driving force transmission members to receive the driving force from said first driving force transmitting member and then to transmit the driving force to said second driving force transmitting member.

7. An apparatus according to claim 6, further comprising a supporting portion, provided movably to said cartridge supporting member, for rotatably supporting said third driving force transmission member.

8. An apparatus according to claim 7, wherein said third driving force transmission member includes, in the state in which said cartridge supporting member is located at the set position, a first gear engageable with said first driving force transmitting member and a second gear engageable with said second driving force transmitting member by movement of said supporting portion when the driving force is transmitted to said first gear.

9. An apparatus according to claim 6, wherein said cartridge supporting member is capable of supporting a plurality of cartridges.

* * * * *